US007963134B2

(12) United States Patent
Rafferty et al.

(10) Patent No.: US 7,963,134 B2
(45) Date of Patent: Jun. 21, 2011

(54) DEADBOLT LOCK

(75) Inventors: Michael Stephen Rafferty, Madison, WI (US); John William Grosz, Waupun, WI (US); Andrew Brian Terrill, Madison, WI (US); Jerry Smith, Littleton, CO (US); Mike Enslow, Milwaukee, WI (US)

(73) Assignee: Master Lock Company LLC, Oak Creek, WI (US)

( * ) Notice: Subject to any disclaimer, the term of this patent is extended or adjusted under 35 U.S.C. 154(b) by 698 days.

(21) Appl. No.: 11/738,762

(22) Filed: Apr. 23, 2007

(65) Prior Publication Data

US 2007/0266747 A1 Nov. 22, 2007

Related U.S. Application Data

(63) Continuation-in-part of application No. 10/711,058, filed on Aug. 19, 2004, now Pat. No. 7,207,199.

(60) Provisional application No. 60/481,268, filed on Aug. 20, 2003.

(51) Int. Cl.
*E05B 47/06* (2006.01)

(52) U.S. Cl. ..... 70/218; 70/223; 70/277; 70/468; 70/487; 192/69.8; 192/84.92; 292/359; 292/DIG. 27

(58) Field of Classification Search ..... 70/149, 70/218, 222–224, 422, 279.1, 276, 277, 472, 70/416, 417, 468, 471, 481–483, 487, 152, 70/153, 188, 189, 432, 438, DIG. 59, DIG. 73; 292/DIG. 27, 359, DIG. 24, 336.3, 150, 347; 192/56.42, 56.61, 69.8, 84.92

See application file for complete search history.

(56) References Cited

U.S. PATENT DOCUMENTS

| | | | | |
|---|---|---|---|---|
| 581,971 | A | 5/1897 | Wichert | |
| 588,673 | A | 8/1897 | Wyman | |
| 625,249 | A | 5/1899 | Durnbaugh | |
| 856,558 | A | 6/1907 | Voight | |
| 861,421 | A | 7/1907 | Young | |
| 1,362,417 | A | 12/1920 | Hammer | |
| 1,389,380 | A | 8/1921 | Raab | |
| RE15,569 | E | 4/1923 | Ottinger | |
| 1,516,152 | A * | 11/1924 | Dumont | 292/347 |
| 1,752,407 | A | 4/1930 | Zapert | |
| 1,783,785 | A | 12/1930 | Habicht | |

(Continued)

FOREIGN PATENT DOCUMENTS

CN 2152033 Y 1/1994

(Continued)

OTHER PUBLICATIONS

International Search Report and Written Opinion from PCT/US2004/027328, mailed May 11, 2005.

(Continued)

*Primary Examiner* — Lloyd A Gall

(74) *Attorney, Agent, or Firm* — Calfee, Halter & Griswold LLP

(57) ABSTRACT

A deadbolt lock includes a deadbolt, a user rotatable actuator, and a lock interface. The user rotatable actuator is operatively connected with the deadbolt for movement of the deadbolt between locked and unlocked conditions when the actuator is changed from an inoperable condition to an operable condition. The lock interface is configured to change the actuator from the inoperable condition to the operable condition in response to proper user manipulation of the lock interface.

28 Claims, 25 Drawing Sheets

U.S. PATENT DOCUMENTS

| | | | | | |
|---|---|---|---|---|---|
| 1,840,416 | A | | 1/1932 | Scrivener | |
| 1,899,876 | A | | 2/1933 | Machinist | |
| 1,909,393 | A | | 5/1933 | Diesel | |
| 1,909,453 | A | | 5/1933 | Brown | |
| 1,937,165 | A | | 11/1933 | Piagneri | |
| 1,937,523 | A | | 12/1933 | Machinist | |
| 1,956,388 | A | | 4/1934 | Kalina | |
| 1,961,187 | A | | 6/1934 | Aldeen | |
| 2,023,742 | A | | 12/1935 | North | |
| 2,035,781 | A | | 3/1936 | Bell | |
| 2,047,795 | A | | 7/1936 | North | |
| 2,062,431 | A | | 12/1936 | Stone | |
| 2,078,168 | A | | 4/1937 | Stone et al. | |
| 2,081,123 | A | | 5/1937 | Stone | |
| 2,094,808 | A | | 10/1937 | North | |
| 2,110,094 | A | | 3/1938 | Pauloski et al. | |
| 2,168,621 | A | | 8/1939 | Lane et al. | |
| 2,224,875 | A | | 12/1940 | Machinist | |
| 2,244,152 | A | | 6/1941 | Hamilton | |
| 2,251,145 | A | | 7/1941 | Machinist | |
| 2,251,146 | A | | 7/1941 | Machinist | |
| 2,289,129 | A | | 7/1942 | Lalonde | |
| 2,292,784 | A | | 8/1942 | Hamilton | |
| 2,297,711 | A | | 10/1942 | Lalonde | |
| 2,297,771 | A | | 10/1942 | LaLonde | |
| 2,435,634 | A | | 2/1948 | Nicolin et al. | |
| 2,481,099 | A | | 9/1949 | Formo et al. | |
| 2,497,329 | A | | 2/1950 | Smith et al. | |
| 2,525,340 | A | | 10/1950 | Clark | |
| 2,655,026 | A | | 10/1953 | Syler | |
| 2,847,846 | A | | 8/1958 | Taylor et al. | |
| 3,031,876 | A | | 5/1962 | Foote et al. | |
| 3,299,678 | A | | 1/1967 | Spencer | |
| 3,312,090 | A | | 4/1967 | Petersen | |
| 3,383,886 | A | | 5/1968 | Hermann | |
| 3,395,557 | A | | 8/1968 | Berkowitz | |
| 3,406,545 | A | | 10/1968 | Siegal et al. | |
| 3,423,970 | A | | 1/1969 | Harrell | |
| 3,447,348 | A | | 6/1969 | Dauenbaugh | |
| 3,512,381 | A | | 5/1970 | Matsunaga | |
| 3,572,069 | A | | 3/1971 | Junkunc | |
| 3,600,916 | A | | 8/1971 | Ruppert | |
| 3,611,761 | A | | 10/1971 | Atkinson | |
| 3,633,388 | A | | 1/1972 | Atkinson | |
| 3,748,878 | A | * | 7/1973 | Balzano et al. | 70/218 |
| 3,792,885 | A | | 2/1974 | Giardina et al. | |
| 3,815,390 | A | | 6/1974 | Stoia | |
| 3,869,901 | A | | 3/1975 | Neary | |
| 3,919,867 | A | | 11/1975 | Lipschutz et al. | |
| 3,939,679 | A | * | 2/1976 | Barker et al. | 70/277 |
| 4,047,408 | A | | 9/1977 | Johns et al. | |
| 4,055,361 | A | | 10/1977 | Moses | |
| 4,073,527 | A | * | 2/1978 | Schlage | 292/347 |
| 4,438,962 | A | | 3/1984 | Soloviff et al. | |
| 4,455,847 | A | | 6/1984 | Hung | |
| 4,534,194 | A | * | 8/1985 | Aydin | 70/278.2 |
| 4,592,453 | A | * | 6/1986 | Fish et al. | 70/269 |
| 4,683,738 | A | | 8/1987 | Berkowitz | |
| 4,709,566 | A | | 12/1987 | Wildenradt | |
| 4,762,212 | A | * | 8/1988 | Fish et al. | 192/24 |
| 4,854,143 | A | * | 8/1989 | Corder et al. | 70/218 |
| 4,901,545 | A | | 2/1990 | Bacon et al. | |
| 4,956,984 | A | * | 9/1990 | Chi-Cheng | 70/277 |
| 4,979,383 | A | | 12/1990 | Tully | |
| 5,010,749 | A | | 4/1991 | Lin | |
| 5,010,752 | A | | 4/1991 | Lin | |
| 5,014,030 | A | | 5/1991 | Aston | |
| 5,018,375 | A | | 5/1991 | Tully | |
| 5,027,629 | A | | 7/1991 | Liu | |
| 5,040,391 | A | | 8/1991 | Lin | |
| 5,058,940 | A | | 10/1991 | Hart | |
| 5,072,976 | A | | 12/1991 | Meszaros | |
| 5,072,978 | A | | 12/1991 | Woodward | |
| 5,087,090 | A | | 2/1992 | Humphrey et al. | |
| 5,113,675 | A | | 5/1992 | Uyeda | |
| 5,150,592 | A | | 9/1992 | Lin | |
| 5,186,030 | A | | 2/1993 | Lin | |
| 5,199,285 | A | | 4/1993 | Lin | |
| 5,421,074 | A | | 6/1995 | Moore | |
| 5,421,178 | A | | 6/1995 | Hamel et al. | |
| 5,447,047 | A | | 9/1995 | Lin | |
| D380,136 | S | | 6/1997 | Denzer, Jr. | |
| 5,640,863 | A | | 6/1997 | Frolov | |
| 5,657,653 | A | | 8/1997 | Hensley et al. | |
| 5,664,448 | A | | 9/1997 | Swan et al. | |
| 5,712,626 | A | | 1/1998 | Andreou et al. | |
| 5,730,456 | A | | 3/1998 | Bowers | |
| 5,797,286 | A | | 8/1998 | Armstrong | |
| 5,813,261 | A | | 9/1998 | Boehlow | |
| 5,845,524 | A | | 12/1998 | Koehler | |
| 5,848,541 | A | | 12/1998 | Glick | |
| 5,884,515 | A | * | 3/1999 | Milman | 70/472 |
| 5,901,590 | A | | 5/1999 | Lai | |
| 5,909,919 | A | | 6/1999 | Wang | |
| 5,934,122 | A | | 8/1999 | Edwards et al. | |
| 5,943,888 | A | | 8/1999 | Lawson | |
| 5,946,955 | A | | 9/1999 | Suggs et al. | |
| 5,950,467 | A | | 9/1999 | Dong | |
| 5,992,189 | A | | 11/1999 | McCaa | |
| 6,021,654 | A | | 2/2000 | McCaa | |
| 6,145,353 | A | | 11/2000 | Doucet | |
| 6,145,358 | A | | 11/2000 | Wu | |
| 6,147,622 | A | | 11/2000 | Fonea | |
| 6,223,567 | B1 | | 5/2001 | Fadul | |
| 6,264,256 | B1 | | 7/2001 | Hankel et al. | |
| 6,286,347 | B1 | | 9/2001 | Frolov | |
| 6,334,348 | B1 | * | 1/2002 | Ming-Chih | 70/472 |
| 6,345,898 | B1 | | 2/2002 | Roach | |
| 6,351,976 | B1 | | 3/2002 | Chen | |
| 6,374,652 | B1 | | 4/2002 | Hwang | |
| 6,378,344 | B1 | | 4/2002 | Gartner | |
| 6,401,501 | B1 | | 6/2002 | Kajuch et al. | |
| 6,401,505 | B1 | | 6/2002 | Kajuch et al. | |
| 6,415,523 | B1 | | 7/2002 | Wood | |
| 6,418,764 | B1 | | 7/2002 | Lerchner | |
| 6,460,903 | B1 | | 10/2002 | Ming-Chih | |
| 6,471,257 | B1 | | 10/2002 | Lu et al. | |
| 6,478,437 | B2 | | 11/2002 | Roach | |
| 6,487,884 | B1 | | 12/2002 | Constantinou | |
| 6,516,643 | B1 | | 2/2003 | Olshausen | |
| 6,517,127 | B1 | | 2/2003 | Lu et al. | |
| 6,598,909 | B2 | | 7/2003 | Lu | |
| 6,601,420 | B1 | | 8/2003 | Boehlow | |
| 6,622,535 | B2 | | 9/2003 | Chiang et al. | |
| 6,647,753 | B2 | | 11/2003 | Engler | |
| 6,691,538 | B1 | | 2/2004 | Yang et al. | |
| 6,708,538 | B1 | | 3/2004 | Walby | |
| 6,725,693 | B2 | | 4/2004 | Yu et al. | |
| 6,729,169 | B2 | | 5/2004 | Moore | |
| 6,758,070 | B2 | | 7/2004 | Yu et al. | |
| 6,793,254 | B1 | | 9/2004 | Galvin | |
| 6,807,834 | B2 | | 10/2004 | Tsai | |
| 6,813,917 | B2 | | 11/2004 | Miller et al. | |
| 6,845,642 | B2 | | 1/2005 | Imedio Ocana | |
| 6,865,913 | B2 | | 3/2005 | Yamagishi | |
| 6,895,791 | B2 | | 5/2005 | Alexander et al. | |
| 6,912,882 | B1 | | 7/2005 | Alonso | |
| 7,003,993 | B1 | | 2/2006 | Zehrung | |
| 7,007,526 | B2 | | 3/2006 | Frolov et al. | |
| 7,069,755 | B2 | | 7/2006 | Lies et al. | |
| 7,096,698 | B2 | | 8/2006 | Walsh, III et al. | |
| 7,207,199 | B2 | | 4/2007 | Smith et al. | |
| 7,222,508 | B2 | | 5/2007 | Dickhans et al. | |
| 7,231,791 | B2 | | 6/2007 | Sakai | |
| 7,275,402 | B2 | | 10/2007 | Luling et al. | |
| 7,472,571 | B1 | * | 1/2009 | Chang | 70/472 |
| 2001/0005998 | A1 | * | 7/2001 | Imedio Ocana | 70/277 |
| 2002/0066294 | A1 | | 6/2002 | Hiese et al. | |
| 2002/0121784 | A1 | | 9/2002 | Chevalier | |
| 2002/0144526 | A1 | | 10/2002 | Ming-Chih | |
| 2002/0166354 | A1 | | 11/2002 | Moore | |
| 2003/0209042 | A1 | | 11/2003 | Yeh et al. | |
| 2003/0209043 | A1 | | 11/2003 | Yeh et al. | |
| 2004/0250578 | A1 | | 12/2004 | Sakai | |
| 2004/0255628 | A1 | | 12/2004 | Meyerle | |
| 2005/0039504 | A1 | | 2/2005 | Smith et al. | |
| 2005/0050929 | A1 | | 3/2005 | Meyerle | |

| | | | | |
|---|---|---|---|---|
| 2005/0184538 | A1 | 8/2005 | Huang et al. | |
| 2006/0042336 | A1 | 3/2006 | Smith et al. | |
| 2006/0065025 | A1 | 3/2006 | Viviano et al. | |
| 2006/0114099 | A1 | 6/2006 | Deng | |
| 2006/0196238 | A1 | 9/2006 | Avni | |
| 2007/0051145 | A1 | 3/2007 | Chang | |
| 2007/0080778 | A1 | 4/2007 | Strader et al. | |
| 2007/0157684 | A1 | 7/2007 | Bogdanov et al. | |
| 2007/0169525 | A1 | 7/2007 | Chang | |
| 2007/0209413 | A1 | 9/2007 | Dobbs | |
| 2007/0214848 | A1 | 9/2007 | Meyerle et al. | |
| 2008/0196457 | A1 | 8/2008 | Goldman | |
| 2008/0236213 | A1 | 10/2008 | Blanch | |
| 2009/0133454 | A1 * | 5/2009 | Frolov et al. | 70/279.1 |

FOREIGN PATENT DOCUMENTS

| | | | |
|---|---|---|---|
| CN | 2176412 | Y | 9/1994 |
| TW | 0250139 | | 8/1983 |
| TW | 0291890 | | 6/1985 |
| TW | 0365285 | | 10/1987 |
| TW | 327912 | | 3/1998 |
| TW | 501634 | | 9/2002 |
| TW | 00550329 | B | 9/2003 |
| TW | 0580039 | Y | 3/2004 |
| WO | 84/02157 | | 6/1984 |
| WO | WO8402157 | | 6/1984 |
| WO | 2005/019569 | | 3/2005 |
| WO | 2005/101294 | | 10/2005 |

OTHER PUBLICATIONS

International Search Report and Written Opinion from International Application No. PCT/US08/61113 mailed Aug. 26, 2008.

* cited by examiner

DEADBOLT LOCK

CROSS-REFERENCE TO RELATED APPLICATIONS

This application is a continuation-in-part of U.S. application Ser. No. 10/711,058, filed Aug. 19, 2004 and entitled "Dead Locking Deadbolt," issued as U.S. Pat. No. 7,207,199 on Apr. 24, 2007, which claims the benefit of U.S. Provisional Application Ser. No. 60/481,268, filed Aug. 20, 2003 and entitled "Dead Locking Deadbolt," both of which are incorporated by reference in their entirety, to the extent that they are not conflicting with the present application.

BACKGROUND

Bolts or deadbolts are well known devices for locking a door shut for security purposes. In such well-known arrangements, the deadbolt or bolt is mounted in the body of the door and the deadbolt is operated by mechanical operating devices mounted on either side of the door. When the deadbolt is operated to a locked position it typically extends or projects from the side of the door into an opening in the door jamb or wall to which the door is mounted. Thus, the deadbolt when operated to an extended position, "bolts" or "locks" the door in a closed position. The mechanical operating devices also can operate to retract the bolt into the side of the door to unlock the deadbolt or bolt.

In typical arrangements, one mechanical device used to operate a deadbolt may be a key cylinder into which a key is inserted. The key then can rotate the cylinder which, in turn, operates the deadbolt through various mechanical linkages. Another mechanical device that may be used to operate a deadbolt includes a knob that can be turned manually that, in turn, operates the deadbolt through any of various mechanical linkages.

It is known to include a key cylinder and knob device together to independently operate a deadbolt. The key cylinder is normally mounted on the exterior side of the door so that a user can use a unique key to operate and lock the deadbolt from the exterior side of the door. The manual knob is typically mounted on the interior of the door and operates the deadbolt from the interior side of the door without a key. Thus, the user can easily lock and unlock the deadbolt from the interior of the door without using or locating a key.

SUMMARY

The present application contemplates mechanisms and configurations for operating a deadbolt. According to an inventive aspect of the present application, a deadbolt lock may include a manually operable lock member movable to operate a deadbolt mechanism in response to proper or authorized manipulation of a lock interface. Many different types of manually operable lock members may be utilized for operation of the deadbolt mechanism. In one embodiment, a manually operable lock member includes a user rotateable actuator or cover that engages a deadbolt mechanism for extension or retraction (i.e., locking or unlocking) of a deadbolt in response to proper manipulation of a lock interface. Many different types of lock interfaces may be used to selectively permit movement of a manually operable lock member to operate a deadbolt mechanism. In one embodiment, the lock interface includes an electronic interface configured to energize or de-energize an electrically operable mechanism (such as, for example, an actuator) in response to an authorized electrical signal, to place the manually operable lock member in an operable condition.

DESCRIPTION OF THE DRAWINGS

Further features and advantages of the present application will become apparent from the following detailed description made with reference to the accompanying drawings, wherein.

DETAILED DESCRIPTION

Figure 1:
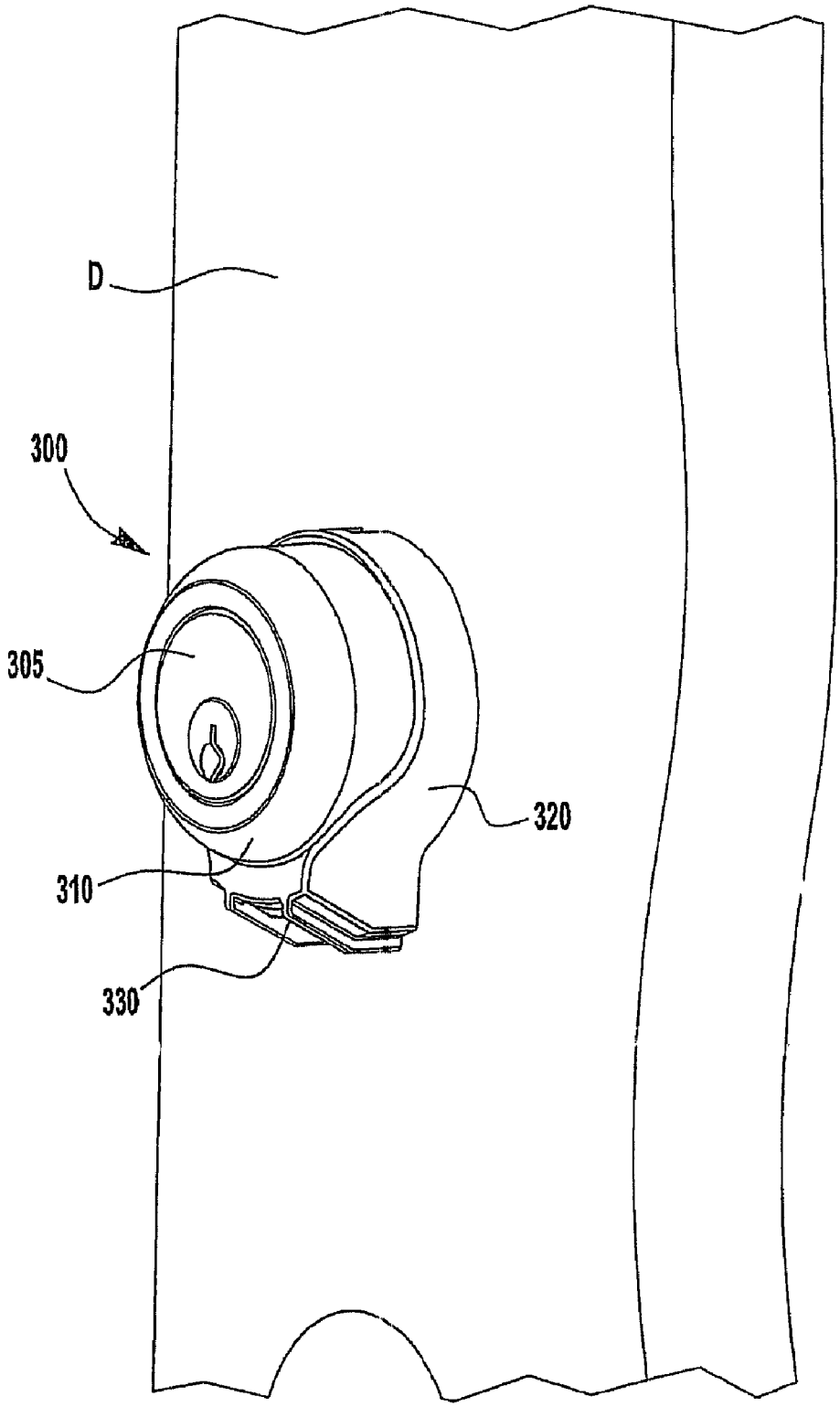
FIG. 1 is a perspective view of an exterior portion of a deadbolt locking arrangement.

The Detailed Description merely describes preferred embodiments of the invention and is not intended to limit the scope of the specification or claims in any way. Indeed, the invention as described is broader than and unlimited by the preferred embodiments, and the terms in the claims have all of their full ordinary meanings.

The present application and the inventive features described herein relate to arrangements and methods for operating a deadbolt mechanism, and/or for restricting or limiting operation of a deadbolt mechanism. With a conventional deadbolt lock, a first deadbolt manipulation mechanism (commonly a key operated lock cylinder) is provided on an exterior side of a door, for locking or unlocking the deadbolt lock from outside a room, building, or other structure. A second manipulation mechanism (commonly a manually operable lever or knob) is generally provided on an interior side of the door, for locking or unlocking the deadbolt lock from inside the structure. According to an inventive aspect of the present application, an additional or alternative lock interface may be provided, for example, on an exterior side of a door, to provide an additional or alternative mechanism for unlocking and locking the deadbolt. In one embodiment, the lock interface may allow for independent unlocking or locking of the deadbolt, without use of a conventional key. In another embodiment, proper manipulation of the lock interface may be required in addition to use of a conventional key, to provide additional security for a deadbolt locked enclosure.

Many difference lock interfaces may be provided for operation of a deadbolt mechanism. While a lock interface may include a key operated lock mechanism, such as a lock cylinder for a traditional bitted key or an electronic card reader for a magnetic key card, a lock interface may also include mechanisms operable through the use of other types of user inputs, such that a key or key card need not be utilized to unlock the deadbolt lock. One example of such user inputs includes the entry of authorized combination codes, for example, using one or more combination dials or a push-button keypad. Still other exemplary user inputs involve conditions that are unique to an individual user, such as, for example, inherent physical traits, also known as biometric authentication. Examples of biometric authentication include, but are not limited to, fingerprint scanning, retinal scanning, video monitoring of facial patterns, hand measurements, and voice recognition.

While a lock interface, such as, for example, the electronic lock interfaces described above, may independently and automatically unlock or lock a deadbolt lock in response to proper or authorized manipulation of the lock interface, a lock interface may alternatively be configured to allow user movement of a manually operable lock member to lock or unlock a deadbolt lock. Such a configuration may, for example, allow for reduced power consumption or output force by an electronic lock interface in a deadbolt lock arrangement, because the force required to physically move the deadbolt between locked and unlocked positions will be applied by the user and not by an electrically powered component within the lock arrangement, such as, for example, a motor, solenoid, or actuator. By reducing the power consumption or output force required to operate the deadbolt lock arrangement, a smaller electrically powered component may be provided, a smaller energy source (e.g., a battery) may be used, and/or a need for battery replacement may be minimized.

According to an inventive aspect of the present application, a deadbolt locking arrangement may be provided with a manually operable locking member for locking and unlocking the deadbolt lock. In one embodiment, the manually operable locking member may be changed from an inoperable condition to an operable condition in response to a proper or authorized manipulation of a lock interface associated with the locking arrangement. Many different types and configurations of manually operable locking members may be provided, including, for example, knobs, wheels, levers, switches, and slides. To lock or unlock the deadbolt lock, a manually operable locking member may be mechanically connected with the deadbolt. As one example, a conventional deadbolt assembly may include an actuating plate or blade which acts to extend the deadbolt to a locked condition when rotated in a first direction (e.g., clockwise), and to retract the deadbolt to an unlocked condition when rotated in a second direction (e.g., counter-clockwise). A manually operable locking member may be configured such that when the locking member is placed in or changed to an operable condition, operation of the locking member rotates the actuating plate to move the deadbolt between locked and unlocked conditions.

While many different types of manually operable locking members and associated locking mechanisms may be utilized for operation of the deadbolt, in one embodiment, a user rotatable actuator or cover is assembled with a deadbolt lock such that rotation of the actuator moves the deadbolt between locked and unlocked conditions. A mechanical linkage between the actuator and the deadbolt transmits rotation of the actuator to lateral movement of the deadbolt between retracted (unlocked) and extended (locked) positions. To limit use of the actuator to operate the deadbolt (for example, when the ring is provided on a publicly accessible exterior side of a deadbolt locked door), proper or authorized manipulation of a lock interface associated with the deadbolt lock may be required to place the actuator in an operable condition for operating the deadbolt. In one embodiment, a locking arrangement may include a blocking mechanism that blocks rotation of the actuator. Upon proper manipulation of the lock interface, the blocking mechanism may be disengage-able from the actuator to allow rotation of the ring and operation of the deadbolt. In another embodiment, a locking arrangement may include a separable mechanical linkage or connection between the actuator and the deadbolt. When a proper manipulation of the lock interface has not been achieved, the actuator remains unlinked or mechanically separated from the deadbolt, such that rotation of the ring does not operate the deadbolt. Upon proper manipulation of the lock interface, a mechanical linkage or connection is initiated between the actuator and the deadbolt, and subsequent rotation of the actuator may unlock or lock the deadbolt.

One such exemplary embodiment of a deadbolt locking arrangement 300 with a manually operable locking member or rotatable actuator 310 is illustrated in FIGS. 1-5. FIG. 1 illustrates an exterior portion of the locking arrangement 300 disposed on an exterior side of a door D. As shown, the locking arrangement 300 may, but need not, also include a key operated lock cylinder 305 for operation of the deadbolt lock. The exemplary locking arrangement 300 includes an exterior housing 320 within which the actuator 310 is assembled and permitted to rotate. The locking actuator 310 in this embodiment is dome shaped and at least partially covers the lock cylinder 305. The shape of the actuator is not limited to a dome, however, and may be any shape, including, without limitation, a simple ring or circular shape. The exemplary exterior housing 320 also retains a lock interface 330 (to be described in greater detail below) configured to receive a proper or authorized user manipulation to place the actuator 310 in an operable condition.

Figure 2:
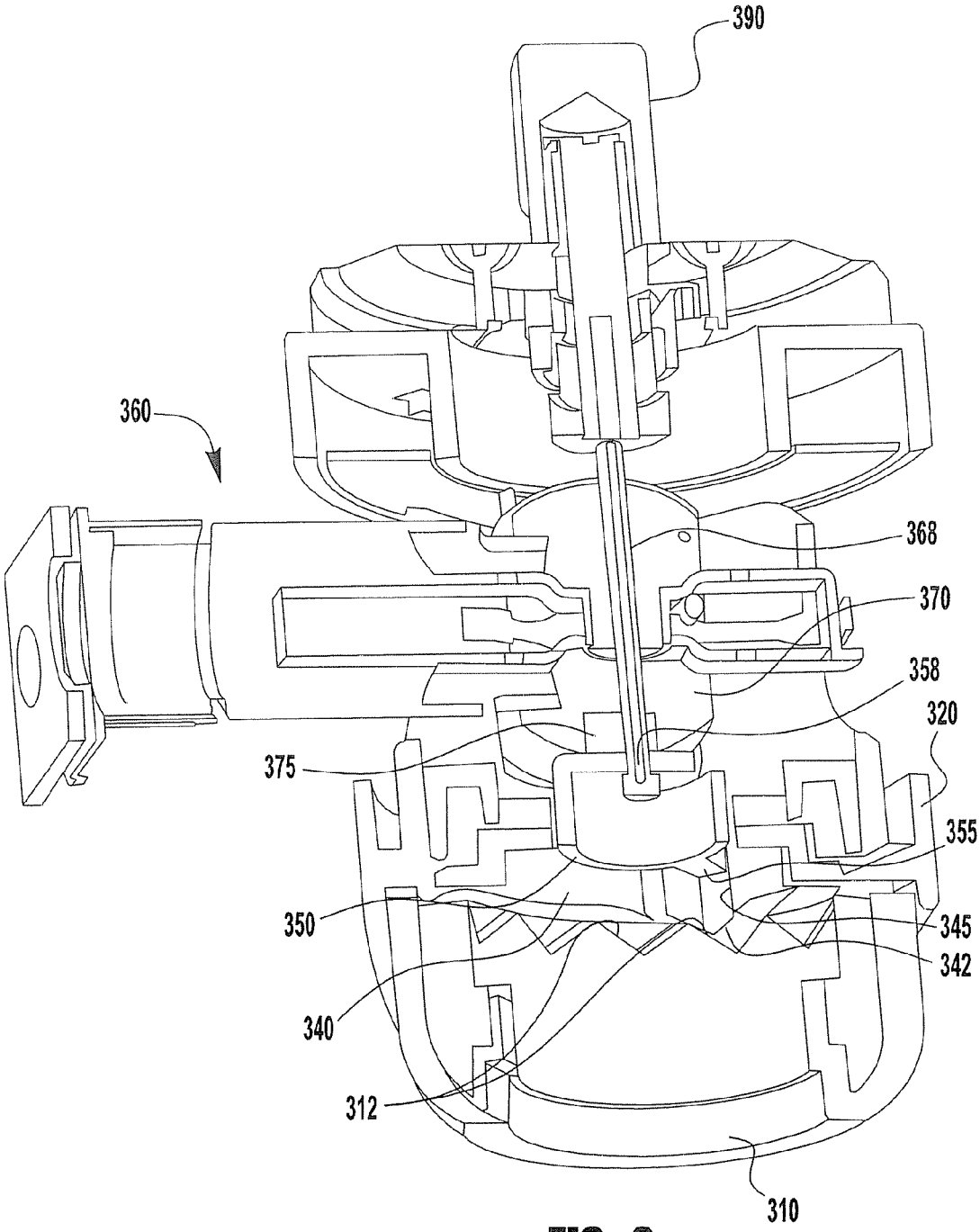
FIG. 2 is an upper cross-sectional view of the deadbolt locking arrangement of FIG. 1, with key cylinder removed to illustrate additional features of the locking arrangement.
Figure 2A:
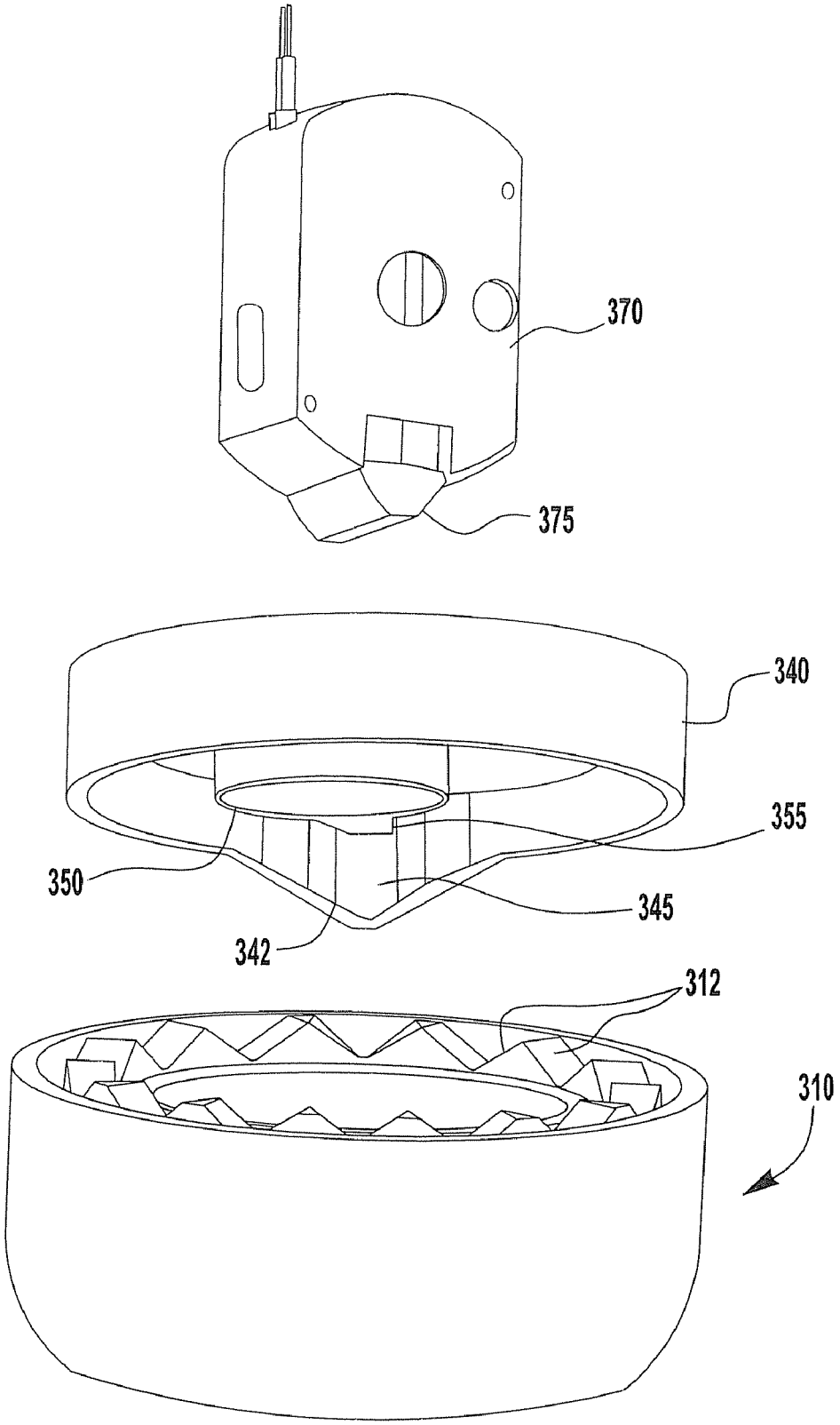
FIG. 2A is a partial exploded perspective view of an actuator, clutch ring, drive arm, and electronic latch for a deadbolt locking arrangement.

Many different mechanisms or configurations may be used to transmit rotation of an actuator or other such manually operable locking member to movement of a deadbolt between locked and unlocked conditions. In one embodiment, a rotatable locking member may be operably connectable with an actuation translating component, with the actuation translating component being directly or indirectly connected with the deadbolt assembly 360. For example, the locking member may include one or more engageable portions or surfaces, such as, for example, notches or protrusions, on an axial end of the locking member, for engaging a corresponding portion or surface on an axially adjacent actuation translating component, which in turn transmits rotation to lateral extension or retraction of the deadbolt. In the illustrated embodiment, as shown in FIGS. 2 and 2A, the actuator 310 includes a series of notches 312 on an annular end face. A rotatable clutch ring 340 disposed within the exterior housing 320 includes at least one axially extending projection 342 configured to engage one of the notches 312 to allow for mutual rotation of the actuator 310 and clutch ring 340. The clutch ring 340 includes an inner recess 345 (which may, but need not, align with the projection 342) for slidably retaining a finger 355 of a rotatable drive arm 350, such that the drive arm 350 rotates with the clutch ring 340. As shown, the drive arm 350 includes a narrow slot 358 through which an elongated member or actuating blade 368 is closely received for rotation of the actuating blade. The actuating blade 368 is connected by known mechanical linkages with a deadbolt assembly 360, such that rotation of the actuating blade 368 in a first direction extends the deadbolt 360 to a locked position, and rotation of the actuating blade 368 in an opposite, second direction retracts the deadbolt 360 to an unlocked position. The actuating blade 368 may further be connected with a key cylinder 305 and an interior deadbolt operating knob 390 for independent rotation of the actuating blade 368 and corresponding movement of the deadbolt 360.

As shown, the drive arm 350 may be positioned to rotate about a central axis that is offset from the axis about which the actuator 310 and clutch ring 340 rotate, for example, to allow for assembly of the actuator 310 around a standard key cylinder 305, and for assembly of the drive arm 350 with an actuating blade 368 extending from a standard key cylinder. The clutch ring recess 345 and drive arm finger 355 may be configured such that the finger 355 remains engaged with the recess 345 over the entire range of rotation of the clutch ring 340 (see FIG. 3). The range of rotation of the clutch ring 340 may be defined, for example, by an opening 322 in the exterior housing 320 through which the projection 342 extends. While operation of a deadbolt lock may involve many different angles of rotation of the drive arm 350 and actuating blade 368, in one embodiment, the drive arm is configured to rotate 90° to provide 90° rotation of the actuating blade 368, consistent with operation of a conventional actuating blade between deadbolt locked and deadbolt unlocked positions. Since the actuator 310 and clutch ring 340 are larger than the drive arm 350 and rotate about an axis offset from the central axis of the drive arm 350, the actuator 310 and clutch ring 340 may be rotated less than 90° to effect a 90° rotation of the drive arm 350.

Figure 3:
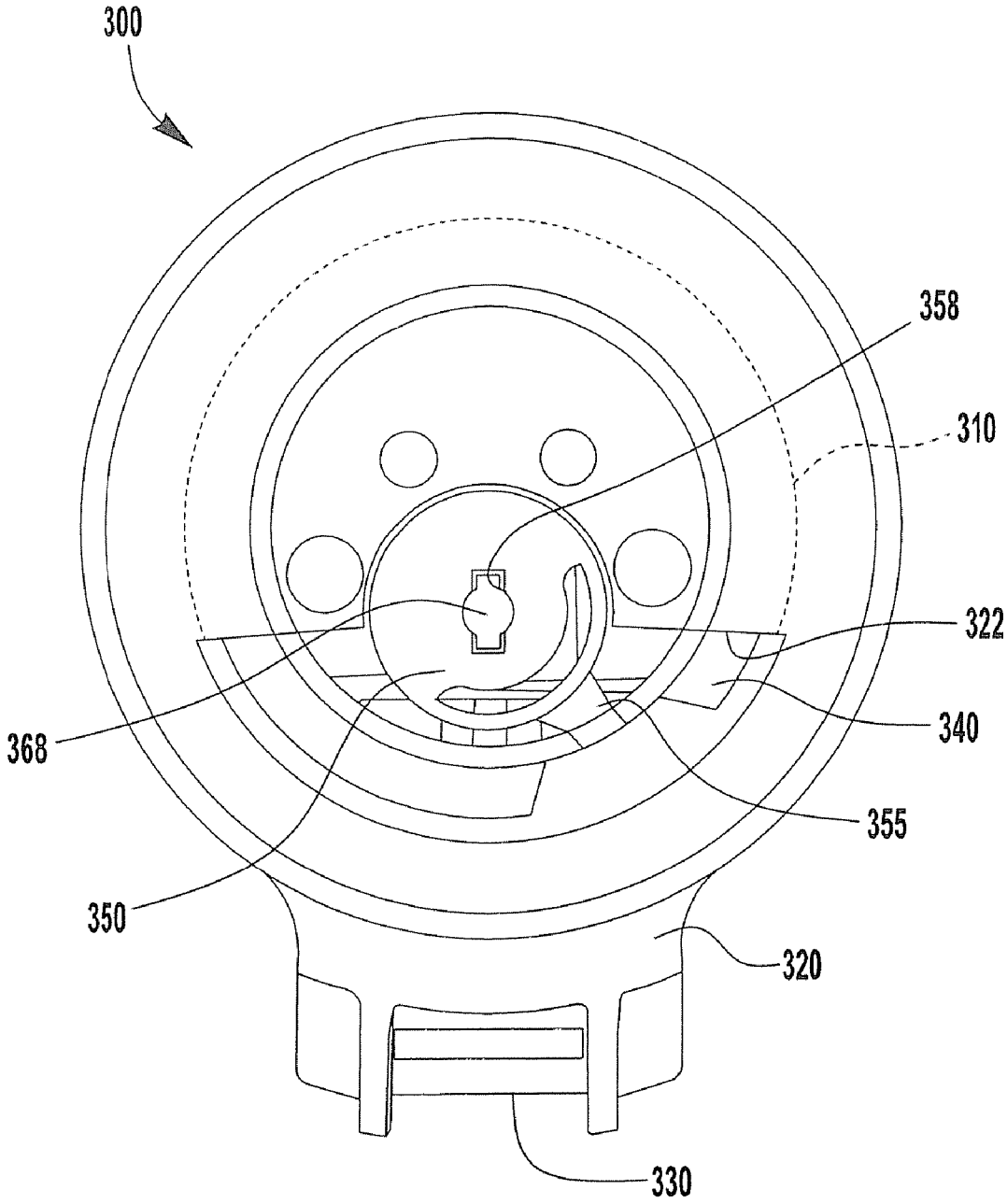
FIG. 3 is a front view of the exterior portion of the deadbolt locking arrangement of FIG. 1, with the key cylinder removed and the actuator shown in phantom.

To prevent unauthorized operation of the user rotatable actuator 310 to unlock or lock the deadbolt lock, the deadbolt locking arrangement 300 may be provided with a separable mechanical linkage between the actuator 310 and the actuating blade 368, such that the actuator remains unlinked or operatively disconnected from the actuating blade 368 until authorized or proper manipulation of the lock interface 330 initiates a mechanical linkage or operative connection between the actuator 310 and the actuating blade 368. While any location between the actuator 310 and the actuating blade 368 may provide a separable operative connection, in one embodiment, a clutch ring 340 is disengageable from the actuator 310 to restrict use of the actuator 310 to unlock the deadbolt. In the illustrated embodiment, the clutch ring 340 is slidable with respect to the actuator 310 to allow for movement between disengaged and engaged positions of the clutch ring projection 342 with the notches 312 of the actuator 310. When the exemplary actuator 310 is in an inoperable condition (e.g., prior to proper manipulation of the lock interface 330), the clutch ring 340 is disengaged or disengageable from the actuator 310, such that when the actuator 310 is rotated, the clutch ring 340, drive arm 350, and actuating blade 368 do not rotate, and the deadbolt 360 is not moved. As shown in FIGS. 2 and 3, the actuator notches 312 and clutch ring projection 342 may include complementary tapered edges, such that when the clutch ring 340 is freely slidable, rotation of the actuator 310 slides the clutch ring 340 to disengage the projection 342 from the corresponding notch 312.

To place the exemplary actuator 310 in an operable condition, proper or authorized manipulation of the lock interface 330 may initiate a mechanism that forces or holds the clutch ring 340 in secure engagement with the actuator, thereby forming an operative connection and preventing disengagement of the clutch ring projection 342 from the corresponding lock ring notch 312 when the actuator 310 is rotated. While many different mechanical or electromechanical mechanisms may be utilized to hold the clutch ring 340 in secure engagement with the actuator 310 for mutual rotation, in the illustrated embodiment, an electrically operated or electronic latch 370 includes a spring loaded plunger 375 that engages the clutch ring 340. When the electronic latch 370 is de-energized, the plunger 375 is retractable, such that rotation of the actuator 310 pushes the clutch ring against the plunger to retract the plunger 375 into the electronic latch 370, allowing for disengagement of the clutch ring projection 342 from the actuator notch 312. When the electronic latch 370 is energized, the plunger 375 is secured in an extended position, which in turn holds the clutch ring 340 in secure engagement with the actuator 310 for mutual rotation of the clutch ring with the actuator. While many different types of latch mechanisms may be used, in one embodiment, a latch with a piezoceramic actuator is included to provide reliable, low power actuation of the deadbolt manipulation mechanism between operable and inoperable conditions. One example of such a latch is a SERVOCELL® Active Latch AL1 a model actuator.

The locking arrangement may be configured such that the actuator is de-energized once the actuator 310 and clutch ring 340 have been rotated for operation of the deadbolt 360. While de-energizing of the electronic latch 370 may occur as a result of a triggering event, such as a switch that is thrown upon rotation of the actuator and clutch ring, in another embodiment, the locking arrangement may be configured to energize the electronic latch 370 only for a predetermined period of time that is sufficient to allow the user to rotate the actuator 310 (for example, 5 to 10 seconds).

To restrict use of a manually operable locking member for locking or unlocking a deadbolt, many different types of lock interfaces may be provided, requiring one or more of many different types of user manipulations to operate the locking member. In some embodiments, a lock interface may be configured to permit access to the holder of a proper key component, such as, for example, a bitted mechanical key, electromagnetic key card, or an infrared, radio wave, or BLUETOOTH® remote transmitter. In other embodiments, a lock interface may be configured to permit access to an individual who has or knows an authorized code, such as, for example, proper positions for a set of combination dials, a proper sequence of numbers or letters entered on a keypad, or an authorized spoken password. In still other embodiments, a lock interface may be configured to permit access to a user having a unique physical or behavioral trait detectable by the lock interface, such as, for example, through electronic analysis of fingerprints, retinas, voice or speech patterns, facial features, hand measurements, or other such distinguishing or unique traits that may be used to confirm the identity of an authorized user. An electronic lock interface may be configured to receive one or more of many different types of data signals, compare the received data signals to one or more stored authorized data signals, and change a locking member from an inoperable condition to an operable condition upon identifying that an authorized data signal has been received.

In the illustrated embodiment, the lock interface 330 includes a fingerprint scanner configured to detect the fingerprint of a user and electronically compare the scanned fingerprint of the user to stored data associated with one or more authorized fingerprints. While many different fingerprint based biometric devices and systems may be incorporated into a deadbolt locking arrangement, one exemplary biometric device and system is described in PCT International Publication No. WO2005/101294, entitled "BIOMETRIC DEVICE," which is incorporated herein by reference in its entirety to the extent that it is not conflicting with the present application. When the exemplary lock interface 330 scans and identifies an authorized fingerprint, the lock interface 330 provides a corresponding electronic signal to initiate placement of the actuator 310 in an operable condition, for example, by energizing an electronic latch 370 to hold a clutch ring 340 in secure engagement or operative connection with a user rotatable actuator 310, as shown in the illustrated embodiment of FIGS. 1-5.

While the exemplary embodiments illustrated and described herein include a lock interface 330 assembled with the exterior lock housing 320, the lock interface may be provided in many different locations, and may, for example, be remote from the rest of the lock assembly, using a wired or wireless connection with the electronic latch 370 for signaling the actuator when an authorized data signal has been received.

Many different methods and configurations may be provided for storing, changing, or deleting authorized data signals from the lock interface 330. In one embodiment (not shown), the lock interface may be placed in a learn mode (for example, by pressing a button after proper manipulation of the lock interface) in which new authorized data signals may be programmed for storage in the lock, for example, on a hard drive or printed circuit (PC) board. Depending on the types of authorized data signals received by the lock interface, this may involve, for example, the entry of an alphanumeric code on a keypad or the scanning of a fingerprint for a new authorized user. Similarly, when the lock interface has been properly manipulated, the lock may be configured to be placed in a delete mode, for deleting an authorized data signal associated with a user for which access is not longer needed or desired.

Figure 4:
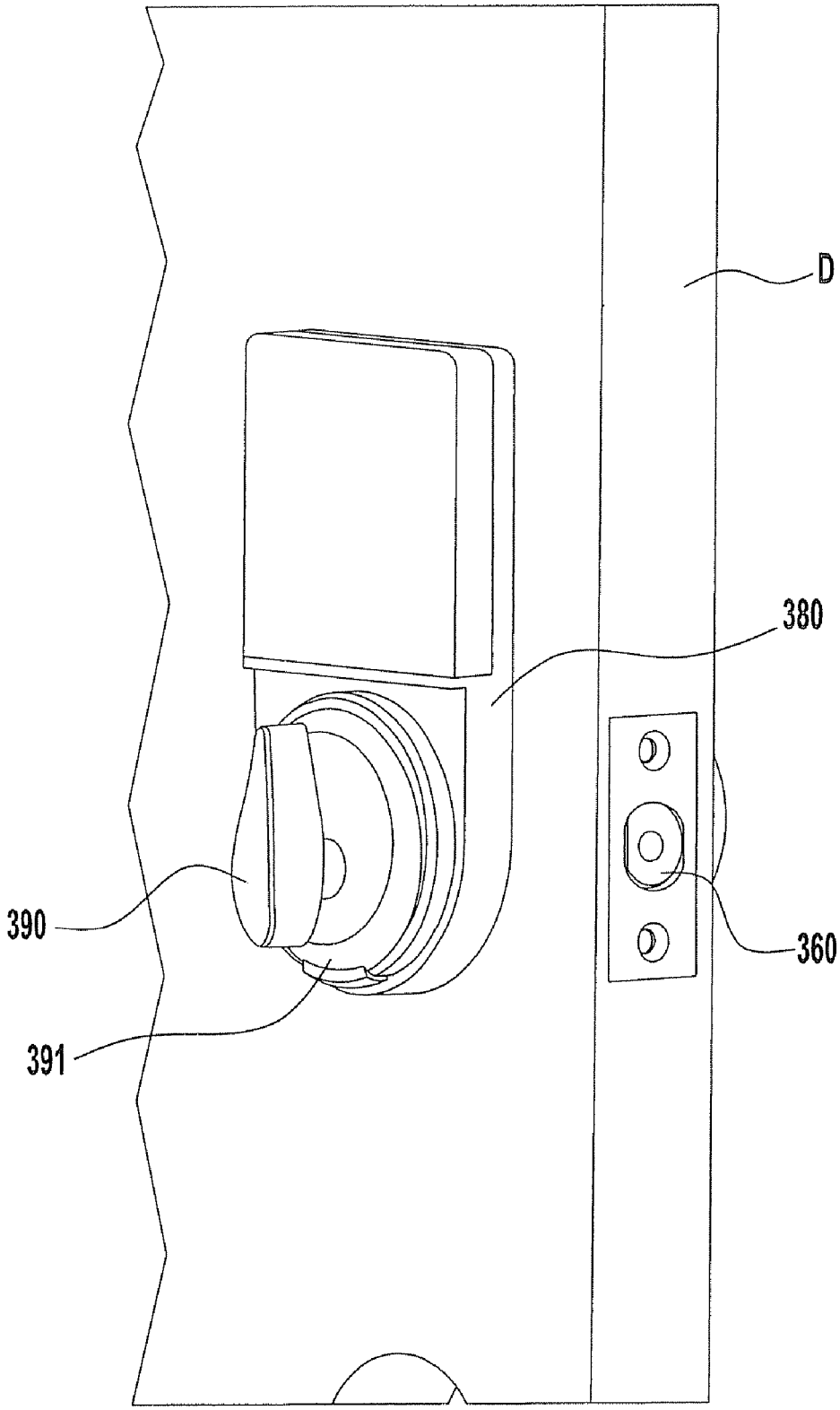
FIG. 4 is a perspective view of the interior portion of the deadbolt locking arrangement of FIG. 1.

FIG. 4 illustrates an exemplary interior portion of the illustrated locking arrangement 300, provided, for example, on an interior side of a door D. The interior portion includes a manually operable knob 390, which may be rotated to move the deadbolt 360 between locked and unlocked conditions. The knob 390 extends from a mounting plate cover 391 and interior housing 380, which cover the fasteners and other lock components on the interior side of the door D.

Figure 5:
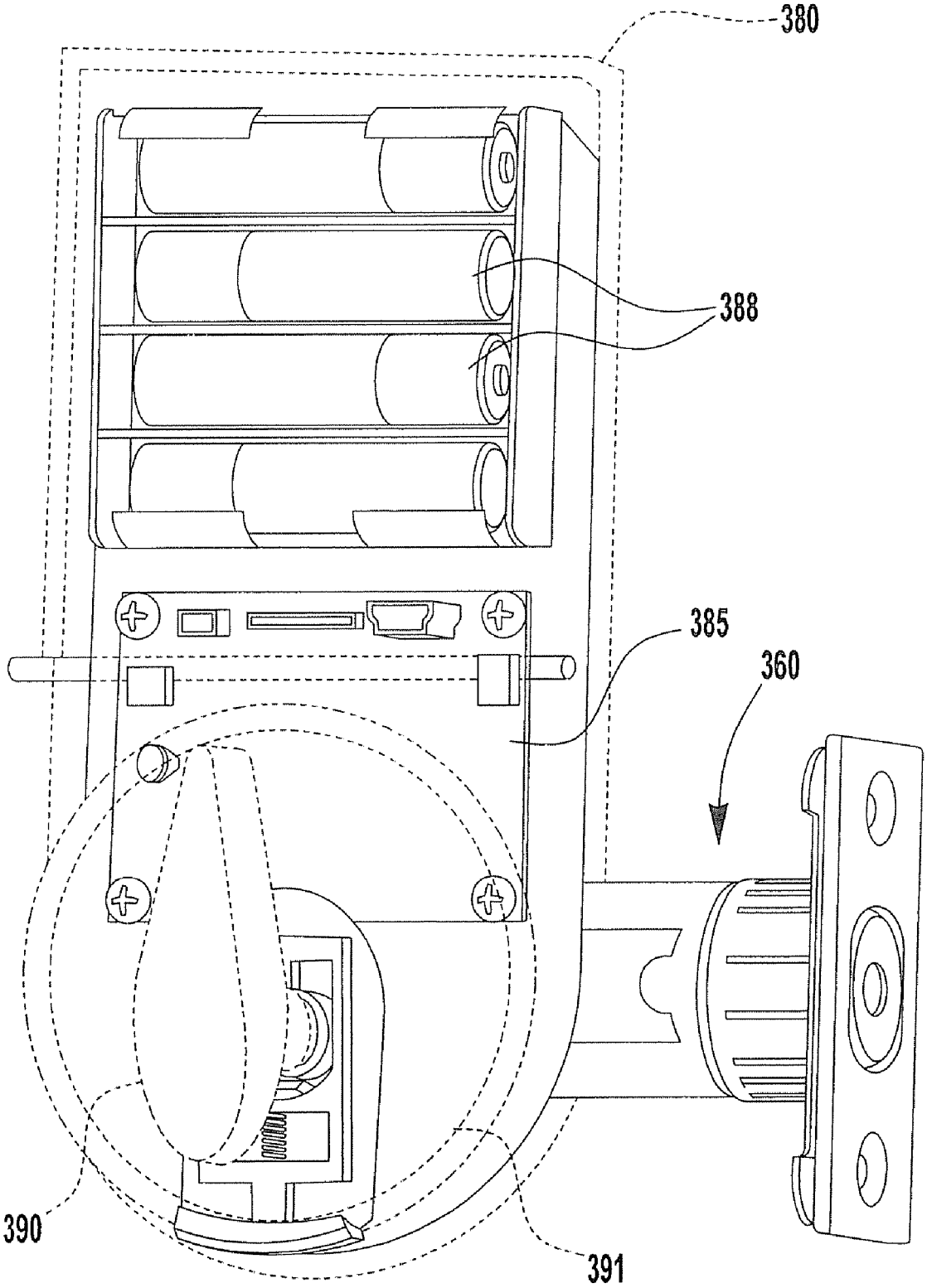
FIG. 5 is a perspective view of the interior portion of the deadbolt locking arrangement of FIG. 1, with interior housing, knob, and mounting plate shown in phantom to illustrate additional features of the locking arrangement.

FIG. 5 illustrates the interior portion of the locking arrangement 300 with knob 390, mounting plate cover 391, and interior housing 380 shown in phantom to show additional interior side lock components. As shown, the exemplary locking arrangement 300 includes a printed circuit (PC) board 385 for storing fingerprint data, receiving data signals from the lock interface 330, comparing received data signals to the stored fingerprint data, and signaling the electronic latch 370 to energize when received data signals are identified as matching stored fingerprint data. The PC board 385 includes suitable ports, connectors, capacitors, and other such components for processing data signals and communicating with the lock interface 330 and electronic latch 370. While any suitable power source may be used to supply power to the PC board 385, lock interface 330 and electronic latch 370, in the illustrated embodiment, batteries 388 are stored within the interior housing 380 and electrically connected with the PC board 385 to provide a compact local power supply. Use of a low power electronic latch 370 and locking mechanism with minimal power usage requirements, as described herein, may provide for extended battery life, thus reducing the likelihood that the biometric enabled locking mechanism is rendered inoperable by battery failure.

According to an inventive aspect of the present application, a deadbolt lock may be provided with a mechanism allowing a user on an interior side of a deadbolt locked door to disable one or more exterior deadbolt manipulation mechanisms, including, for example, a conventional key cylinder operated mechanism, or a lock interface enabled manually operable mechanism, such as the user rotatable actuator 310 described above. This feature may be desirable in situations in which the user does not wish to permit a person with a key or authorized code or trait to operate the deadbolt from the exterior side of the door such as, for example, a landlord/tenant situation in which the tenant does not wish the landlord to enter a rental property. Another important use of this feature is to prevent unauthorized access through the manipulation of the deadbolt by lock "picks" or the like. Likewise, it may also be desirable to prevent movement of a deadbolt to a locking condition, either through use of an exterior deadbolt manipulation mechanism, or through accidental or unintentional operation of an interior deadbolt manipulation mechanism. This may occur in situations where a small child may have access to a deadbolt lock, and a user wishes to prevent the child from inadvertently locking the deadbolt. Mechanisms that disable the operation of a mechanical device used to operate a deadbolt are called "deadlocking," "lockout," or "holdback" devices.

FIGS. 6-23 illustrate one exemplary deadbolt lockout device as used with a conventional deadbolt locking arrangement (i.e., without a lock interface enabled manually operable locking member).

Figure 6:
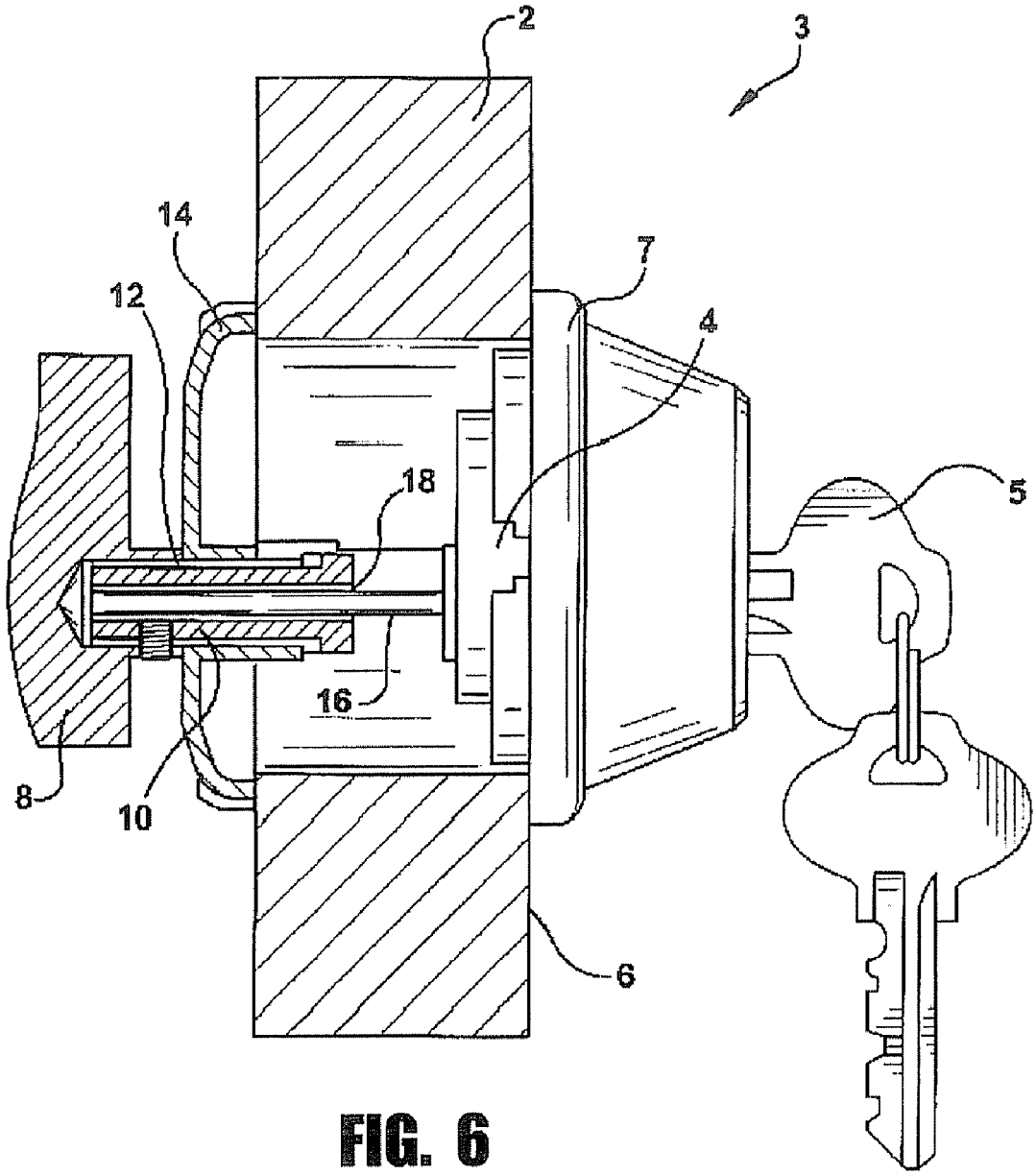
FIG. 6 is a partial cross-sectional view of the deadbolt lockout mechanism.

Referring now to FIG. 6, a door 2 including one embodiment of the present application is shown. As can be seen, a deadbolt manipulation mechanism, such as a conventional key cylinder 4 is mounted on one side of the door 2 which permits the deadbolt mechanism 3 to be operated by a key 5. The key cylinder 4 is normally mounted on the exterior side 6 of the door 2 in a protective housing 7. The "exterior-side" of a door is the side which is on the outside wall of a dwelling or building or any space desired to be "locked" from unauthorized entry. However, this invention is not limited to such a configuration and the key cylinder may be mounted on the interior or exterior side of the door. A second deadbolt manipulation mechanism, such as a knob or handle 8 also for operating the deadbolt is mounted on the side of the door opposite the key cylinder 4. The knob or handle 8 is mounted on a shaft 10 further described below. The shaft 10 is, in turn, mounted in an opening 12 in a shaft housing 14.

The key cylinder 4 includes an elongated member 16 sometimes called a "tailpiece" that may be generally rectangular in cross-section, or may be adapted for other configurations. The elongated member 16 is connected to the rear of the key cylinder 4. When the key cylinder 4 is rotated by key 5, member 16 is also rotated. Member 16 is then connected by known mechanical linkages to a bolt or deadbolt (not shown). When member 16 is rotated in one direction the deadbolt is extended into a locked position. When member 16 is rotated in the opposite direction, the deadbolt is retracted into the door 2 into an unlocked position. This type of locking and unlocking action for a deadbolt through a key cylinder 4 is known.

Figure 7:
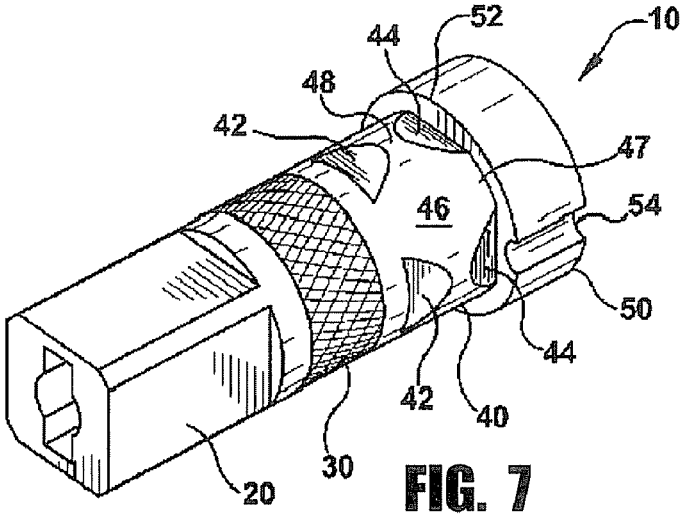
FIG. 7 is a perspective view of the shaft used in the deadbolt lockout mechanism.
Figure 8:
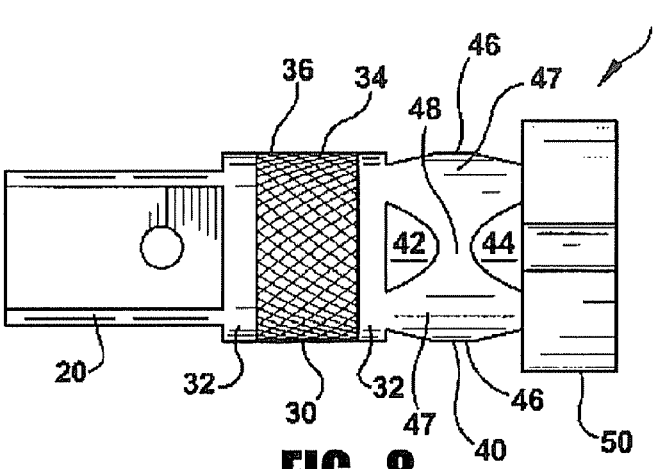
FIG. 8 is a side view of the shaft shown in FIG. 7.
Figure 9:
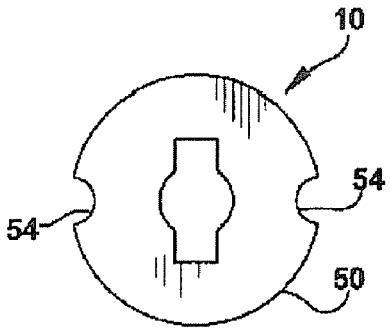
FIG. 9 in an end view of the shaft shown in FIG. 7.
Figure 10:
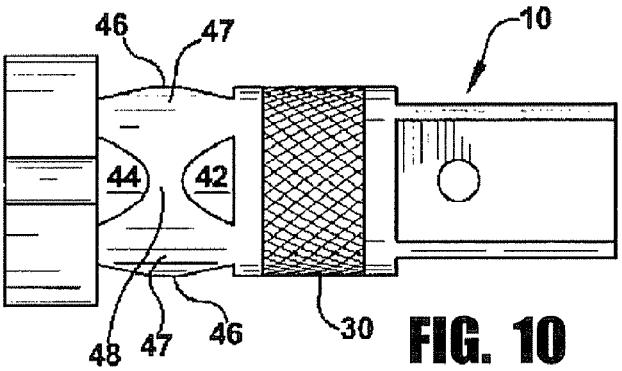
FIG. 10 is a side view of the shaft shown in FIG. 7, opposite from that shown in FIG. 8.
Figure 11:
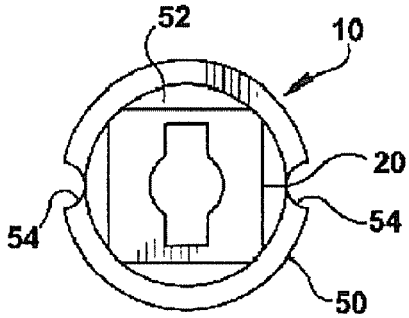
FIG. 11 is an end view of the shaft shown in FIG. 7, opposite from that shown in FIG. 9.

As can be seen in FIG. 7, shaft 10 is hollow in that it has a cavity 18 that extends along its entire length in a horizontal direction when shaft 10 is mounted in shaft housing 14. Member 16 extends from key cylinder 4 into cavity 18 of shaft 10. Thus, when knob 8 is rotated, shaft 10 rotates and then member 16 also rotates. Accordingly, the deadbolt can be operated through use of two different deadbolt manipulation mechanisms, such as handle 8 and key cylinder 4. Thus, both handle 8 and key cylinder 4 may be used to operate the same deadbolt through the rotation of member 16.

Referring now to FIGS. 7-11, shaft 10 is shown. Shaft 10 is comprised of four different subsections along its length. The first subsection is the knob mounting portion 20. Knob mounting portion 20 is generally rectangular or square in cross-section in one embodiment, but could be comprised of any cross-sectional shape. When shaft 10 is mounted in shaft housing 14, knob mounting portion 20 extends from the exterior of shaft housing 14. Knob 8 is then mounted on knob mounting portion 20 by fitting mounting portion 20 into a recess on knob 8. Knob 8 is then secured to mounting portion 20 through the use of known connective methods, such as, for example, a set screw.

The second portion of shaft 10 is signal portion 30. Signal portion 30 is circular in cross-section in one embodiment, but similar to mounting portion 20, its construction is not limited to any particular cross-sectional shape. Signal portion 30 has two boundary walls 32 that form a recessed area 34. An indication mechanism, such as, for example, a colored, circular plastic clip 36 is snap-fit around shaft 10 to fit into recessed area 34 between walls 32. An alternative indication mechanism is direct application of color to the signal portion 30 of the shaft 10. The indication mechanism can be of any color, but a visually distinct color typically used to give alerts or signals such as red, orange or yellow should be used. Alternatively, other indication mechanisms can be used, such as, for example, engravings, knurling, demarcations, recesses, or other physical marking or add on portion that would provide a visible indication to the user that the shaft 10 was pulled-out and the deadbolt mechanism 3 was in lockout position. Optionally, other indication mechanisms could be used, including electronic mechanisms or audible mechanisms.

The third portion of shaft 10 is camming portion 40. Camming portion 40 has a cross-section that is not typical in that it is comprised of several cam surfaces 42, 44 and 46. Camming portion 40 is essentially comprised of eight different sides. Four sides 47 of camming portion 40 are comprised of four camming surfaces 46. The other four sides 48 are each comprised of two camming surfaces 42 and 44. Sides 47 and sides 48 alternate around the circumference of camming portion 40.

The fourth subsection of shaft 10 is head portion 50. Head portion 50 is generally circular in cross-section in one embodiment, but is not limited in any way to any particular cross-sectional shape. Head portion 50 has a diameter or cross-sectional width that is greater than any of the other three shaft portions 20, 30, 40 such that a ridge or lip 52 is formed between head portion 50 and camming portion 40.

Head portion 50 has two grooves, openings or depressions 54 in its otherwise generally circular perimeter. These depressions 54 are on opposite sides of head portion 50 and are parallel to the horizontal axis of the shaft 10 when mounted in shaft housing 14. Depressions 54 need not be of any particular shape, but in the embodiment shown in FIGS. 7, 8 and 9 they are semi-circular in shape and form a groove-like depression. Depressions 54 could be located anywhere on head portion 50 in addition to the location shown in the embodiment depicted in FIGS. 7-11.

Figure 12:
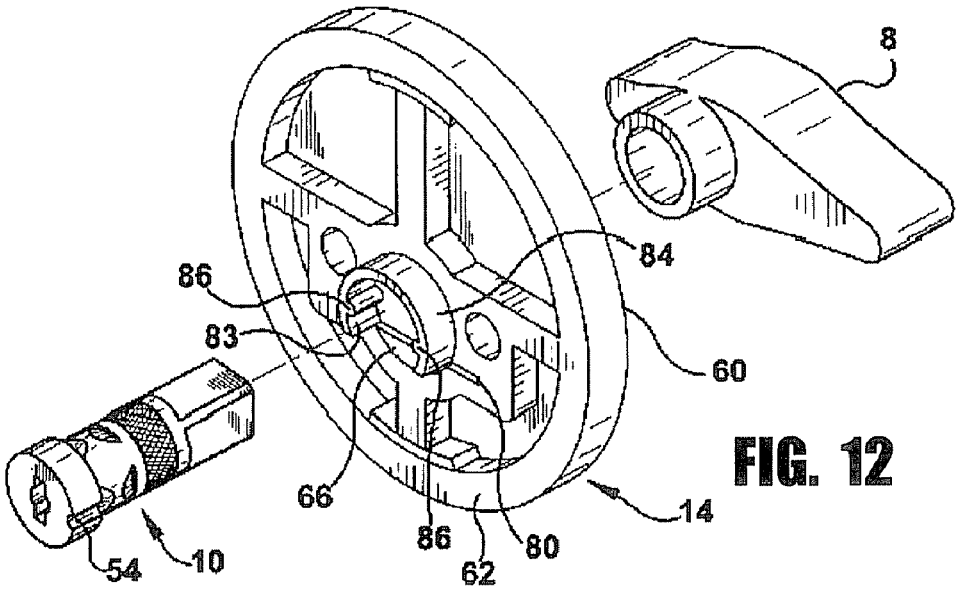
FIG. 12 is an exploded view of the shaft, mounting plate and knob subassembly of a deadbolt locking mechanism.
Figure 13:
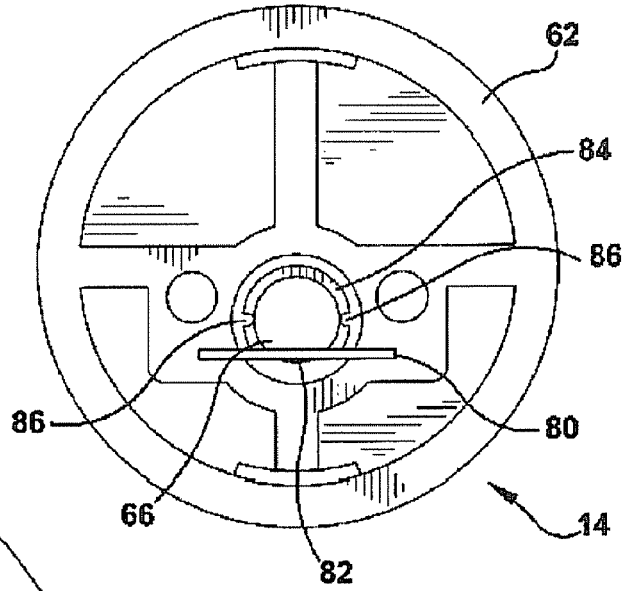
FIG. 13 is a plan view of the mounting plate shown in FIG. 12.
Figure 14:
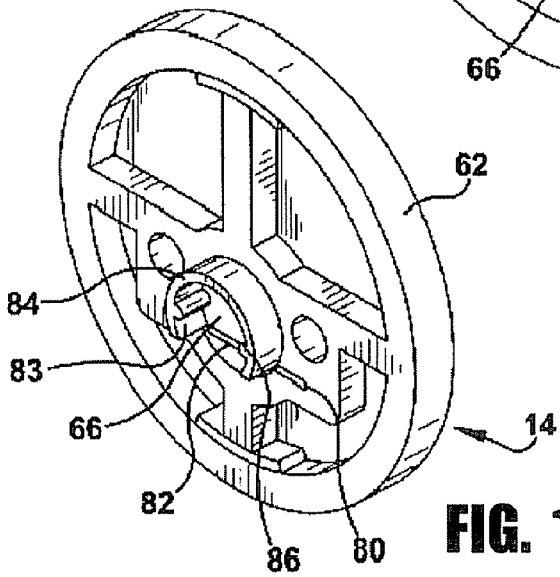
FIG. 14 is a perspective view of the mounting plate shown in FIG. 12.
Figure 16:
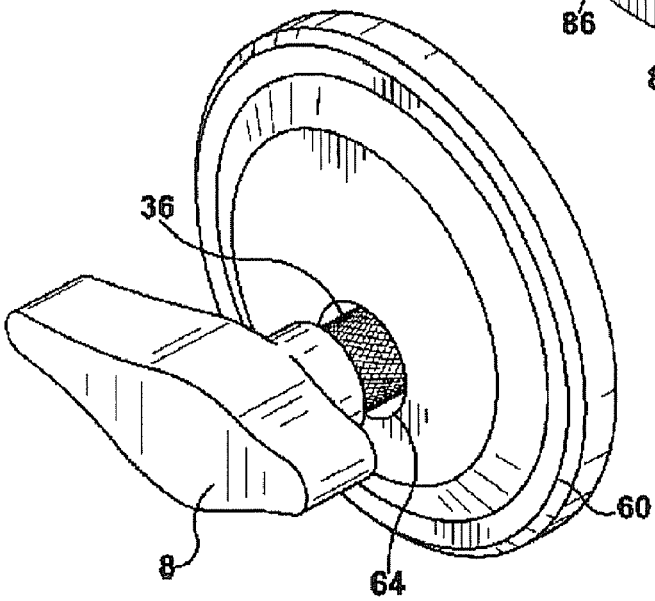
FIG. 16 is a front perspective view of the subassembly of FIG. 12, shown in the lockout position.

Referring now to FIGS. 12-14, shaft housing 14 is described. Shaft housing 14 is comprised of an outer decorative plate 60 and a mounting plate 62. Both plates 60 and 62 have an opening 64 (as seen in FIG. 16) and 66, respectively, for accommodating shaft 10. Between plates 60 and 62 a signal disk is mounted and is recessed from the surface of decorative plate 60. Decorative plate 60 covers the exterior surface of mounting plate 62.

The interior or door facing side of mounting plate 62 includes a groove 80. Groove 80 holds a spring or detent device 82. Detent device 82 is a spring wire in the embodiment shown, but any type of known device that creates a spring, resilient or holding force can be used. The detent device 82 operates on cam surfaces 42 and 44 of shaft 10 as set forth below and serves to hold the shaft in, or urge it into, either a locked or unlocked position. The total shaft length can be of any dimension, but is preferably between 15 and 75 millimeters.

The mounting plate 62 also includes a collar 84 that extends from plate 62 around opening 66 except where biasing device 82 is located. In the embodiment shown in FIGS. 12-14, collar 84 is circular or semi-circular in shape, but any shape that corresponds to the shape of head portion 50 of shaft 10 can be used. Collar 84 also has two protrusions or protuberances 86 that extend from the inside walls 83 of collar 84. These protuberances 86 extend out from the wall of collar 84 approximately 2-3 millimeters to their tips and preferably can extend out from the inside walls of the collar anywhere from 1 millimeter to 2 centimeters. Protuberances 86 correspond to depressions 54 on the head portion 50 in shape and location, and, in this embodiment run parallel to the horizontal axis of shaft 10 when it is mounted in opening 66.

Figure 17:
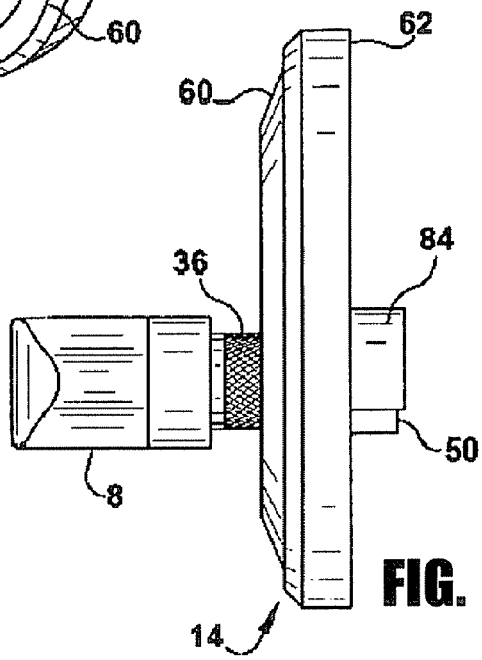
FIG. 17 is a side view of the subassembly of FIG. 12, shown in the lockout position.
Figure 18:
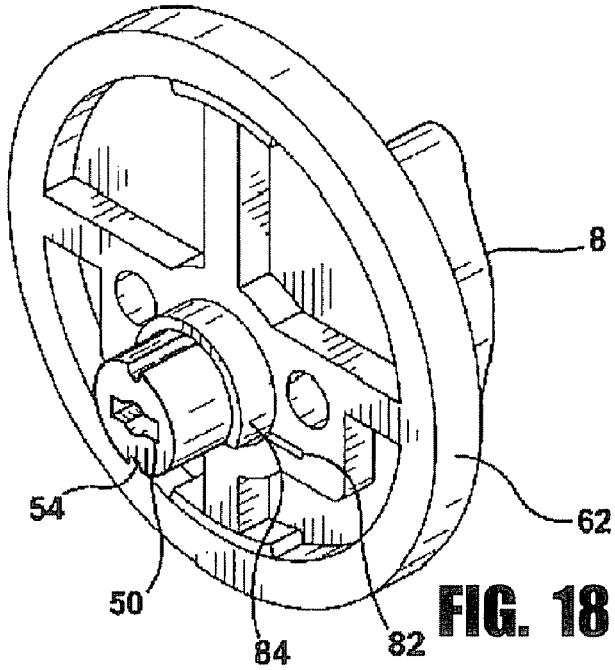
FIG. 18 is a rear perspective view of the subassembly of FIG. 12, shown in the operational deadbolt position.
Figure 19:
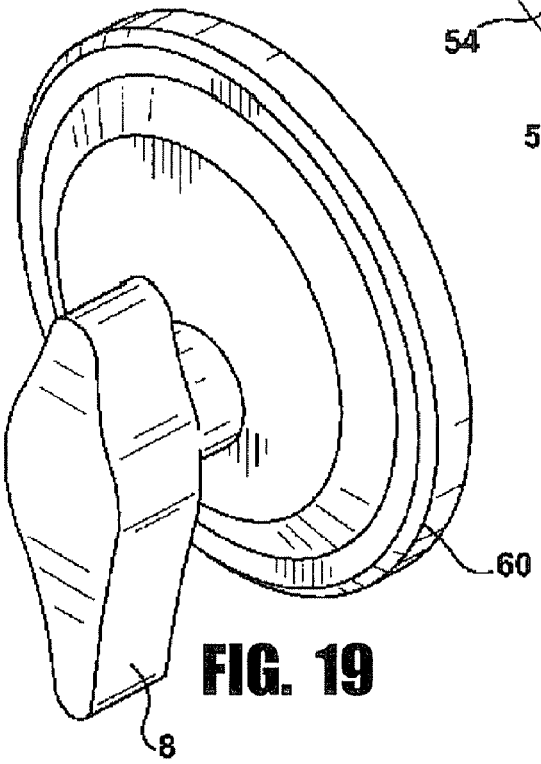
FIG. 19 is a front perspective view of the subassembly of FIG. 12, shown in the operational deadbolt position.
Figure 20:
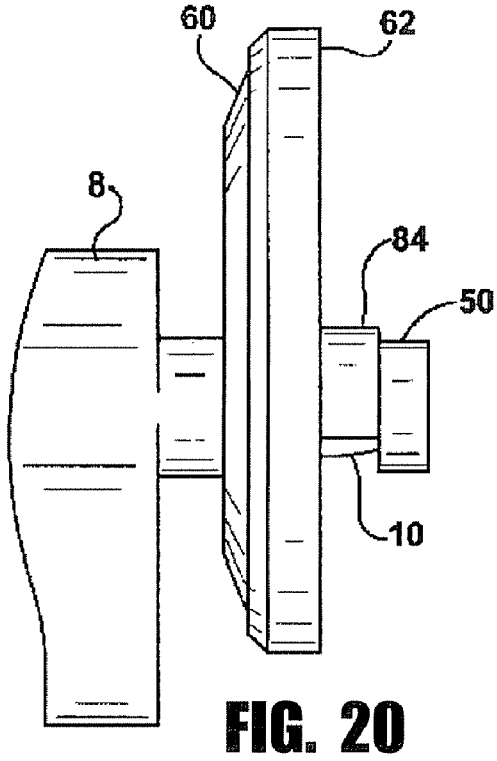
FIG. 20 is a side view of the subassembly of FIG. 12, shown in the operational deadbolt position.
Figure 21:
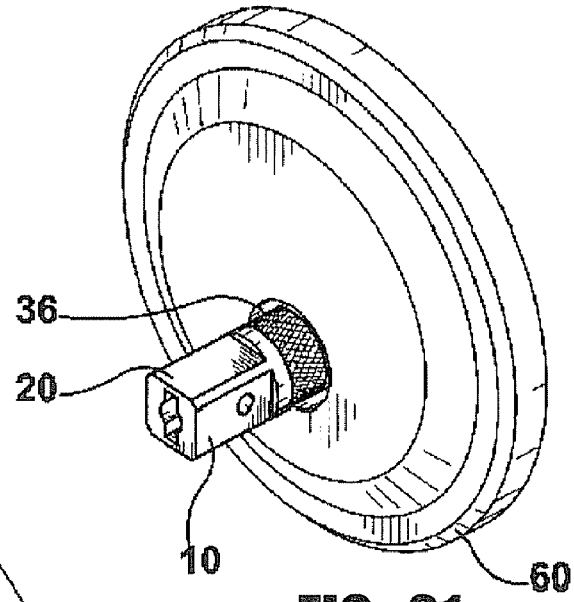
FIG. 21 is an assembly view of the mounting plate and shaft subassembly in the lockout position.
Figure 22:
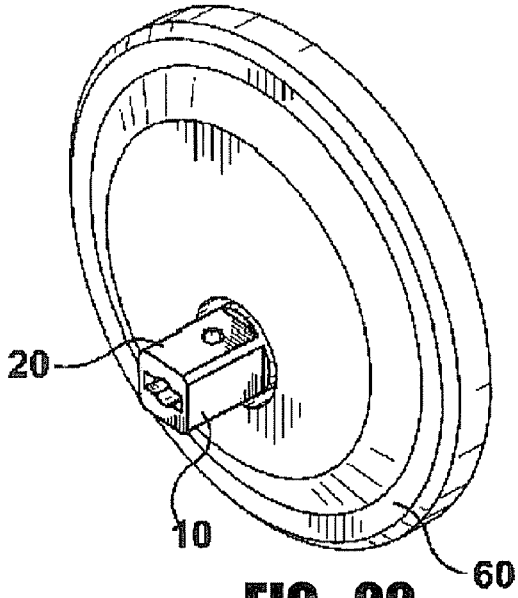
FIG. 22 is an assembly view of the mounting plate and shaft subassembly in the operational deadbolt position.
Figure 23:
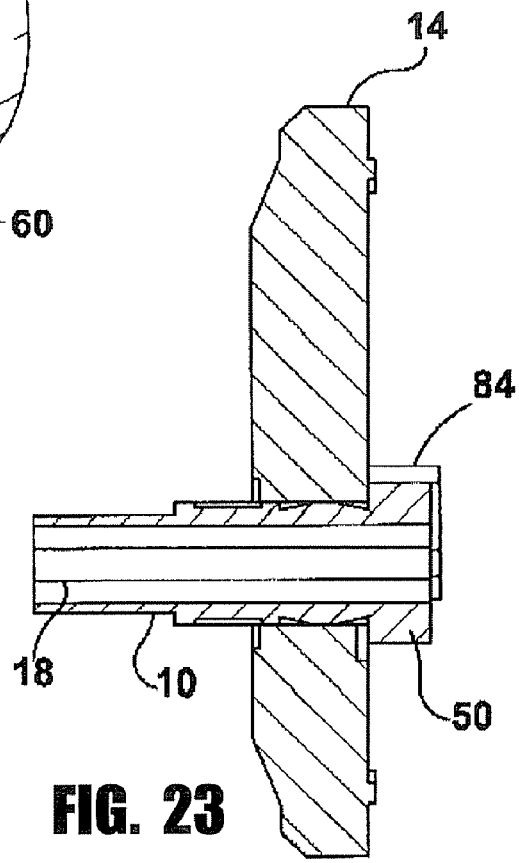
FIG. 23 is a cross-sectional view of the mounting plate and shaft subassembly in lockout position.

Now referring to FIGS. 15-23, the operation of one embodiment of the present application is described. As shown in FIGS. 18-20, the deadbolt mechanism 3 is in an unlocked position. As can be seen, head portion 50 extends beyond collar 84. Thus, handle 8 can be rotated clockwise or counter clockwise to a locked position which would extend the deadbolt into a locked position. When handle 8 is rotated to the locked position, one of camming surfaces 46 operates against detent device 82 to "snap" the shaft 10 into the locked position.

Figure 15:
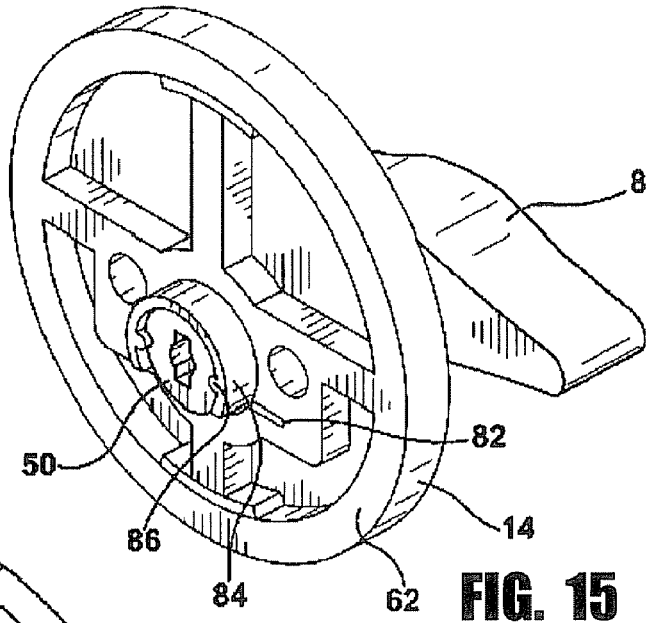
FIG. 15 is a rear perspective view of the subassembly of FIG. 12, shown in the lockout position.

Referring now to FIGS. 15-17, the shaft 10 is shown in the locked position. As can be seen, the depressions 54 correspond to and are "keyed" to protuberances 86 in the locked position. In this position, the deadbolt is extended from the door into the locked position.

To operate the lockout function the handle 8 is pulled outwardly from the door 2. This causes detent device 82 to act against camming surface 42 so that an adequate pulling force must be applied to handle 8 to overcome the spring or resilient force against the cam surface 42. This tends to prevent accidental operation of the lockout function.

As shaft 10 is pulled out by handle 8, protuberances 86 fit into depressions 54 allowing the shaft 10 to continue to be pulled. When detent device 82 reaches the end of cam surface 42 it "snaps" or moves onto downward sloping cam surface 44, effectively, pushing the head portion 50 into full interlocking engagement with the collar 84, which is the lockout position of the complete assembly.

In this lockout position, as shown in FIGS. 16 and 17, the protuberances 86 and the depressions 54 are in an interlocking relationship such that the deadbolt can not be operated by key cylinder 4 and key 5. This is the result of member 16 being held stationary by engagement between the shaft 10 and housing 14. The engagement of the shaft 10 with the housing 14 is a result of the head portion 50 of the shaft nesting within the collar 84 of the housing 14 with the depressions 54 engaging the protuberances 86 on the collar.

In the lockout position, the signal portion 30 of the shaft 10 and indication mechanism 36 becomes visible to the user indicating that the lockout function is in operation and must be disengaged to operate the deadbolt.

To disengage the lockout function, the user simply pushes on handle 8. The same "snapping" camming surface operation will occur when the pushing force overcomes the spring force of detent device 82 on camming surface 44. This will cause the lockout function to disengage, thereby allowing handle 8 to be rotated which rotates member 16 and moves the deadbolt to the unlock position.

In an alternate embodiment, a person ordinarily skilled in the art would understand that the depressions 54 could be present in the collar 84 and the corresponding protuberances 86 could be present in the head portion 50. It should also be understood that deadbolt manipulation mechanisms are not limited simply to a key cylinder and handle, but may take the form of various mechanical devices. Nor are the inventive features limited to use with deadbolts or bolts, but can be used with any known locking mechanism.

Figure 24:
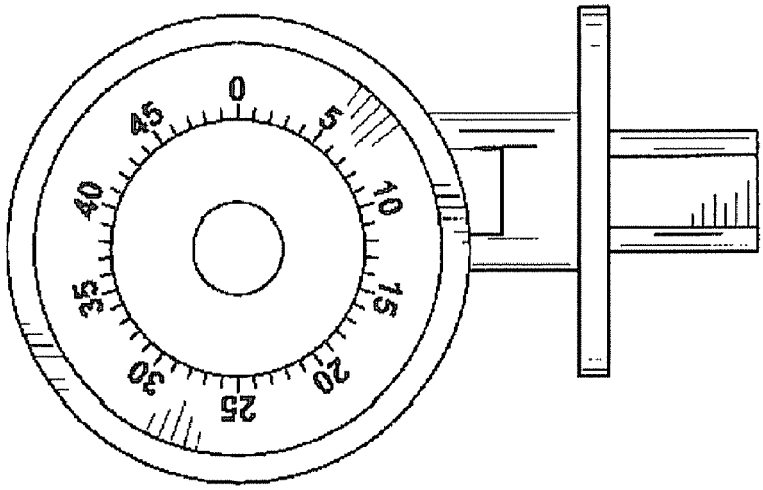
FIG. 24 illustrates a device for operating a locking device that can be operated through the use of a combination dial or a key cylinder.

The inventive features can be used with any mechanical device that can operate any locking mechanism, including a combination-type mechanical device or a device that can be operated by a combination dial or a key cylinder alternatively and interchangeably. In such a device, a user can operate a locking mechanism, including a deadbolt, by rotating a dial using an authorized numerical combination or by using the key cylinder. Such a device is depicted in FIG. 24.

According to another inventive aspect of the present application, a deadbolt lockout device may be provided with a mechanism for enabling use of the lockout device, to reduce the risk of unintentional or inadvertent lockout of a deadbolt locking arrangement. Many different mechanisms may be provided to selectively enable use of the lockout device, including, for example, buttons, levers, wheels, and fasteners. Where a lockout device relies on axial movement of an actuating shaft, such as, for example, the embodiment of FIGS. 6-23, the lockout enabling mechanism may include a component that obstructs axial movement of the shaft until a user operable member is manipulated to release or remove the obstruction from the shaft.

Figure 25:
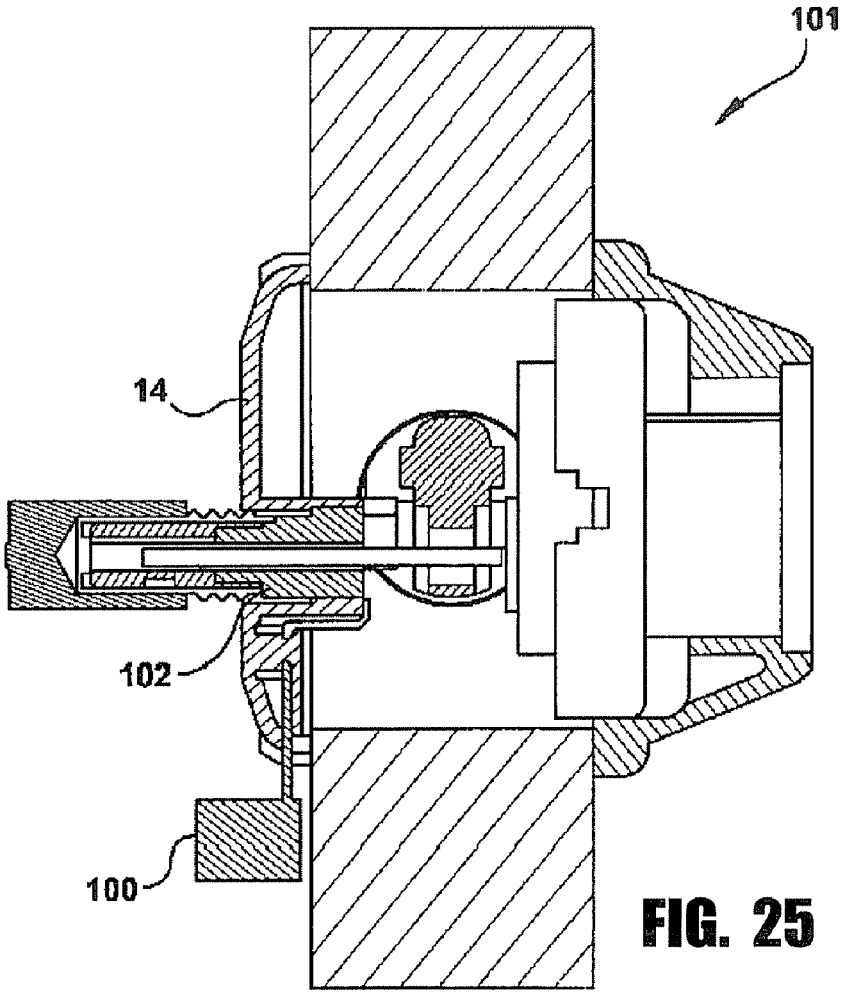
FIG. 25 is a partial cross-sectional view of a deadbolt lockout mechanism that incorporates a release mechanism.

Referring to FIG. 25, an exemplary embodiment of a deadbolt locking arrangement with lockout device and a lockout enabling mechanism is described. In this embodiment a further feature limits the possibility of inadvertently placing the device in a lockout position. A release mechanism 100 is incorporated into a deadbolt mechanism 101. The release mechanism 100 enters the deadbolt mechanism 101 through the shaft housing 14 and is in direct or indirect contact with the shaft 102. As described above, the lockout function can be either active (i.e. the shaft 102 is in a lockout position and a key cylinder can not operate the deadbolt) or the lockout function is inactive (i.e. the shaft 102 is not in a lockout position and the deadbolt can be operated with a key cylinder). The shaft 102 can be placed in a lockout position only when the release mechanism 100 is manually actuated, thus a user needs to use two hands, one to manipulate the release mechanism 100 and one to manipulate the knob or handle 8, in order to place the shaft 102 in a lockout position. This added constraint decreases the likelihood that a user would inadvertently place the lockout mechanism in an undesired state.

Although a user would need to use two hands to place the shaft 102 in a lockout position, which activates the lockout function, the user can deactivate the lockout function by simply manipulating the knob or handle 8 with one hand. Typically, the lockout function can be deactivated by pushing on the knob 8, which removes the shaft 102 from the lockout position and allows the key cylinder to manipulate the deadbolt.

In an alternative embodiment, the user must actuate the release mechanism 100 to either activate or deactivate the lockout function. A person skilled in the art would recognize that the release mechanisms 100, as described herein, are only exemplary illustrations. A number of variations will occur to those reading and understanding the description. It is intended that such variations be included in the specifications.

Figures 26, 26A:
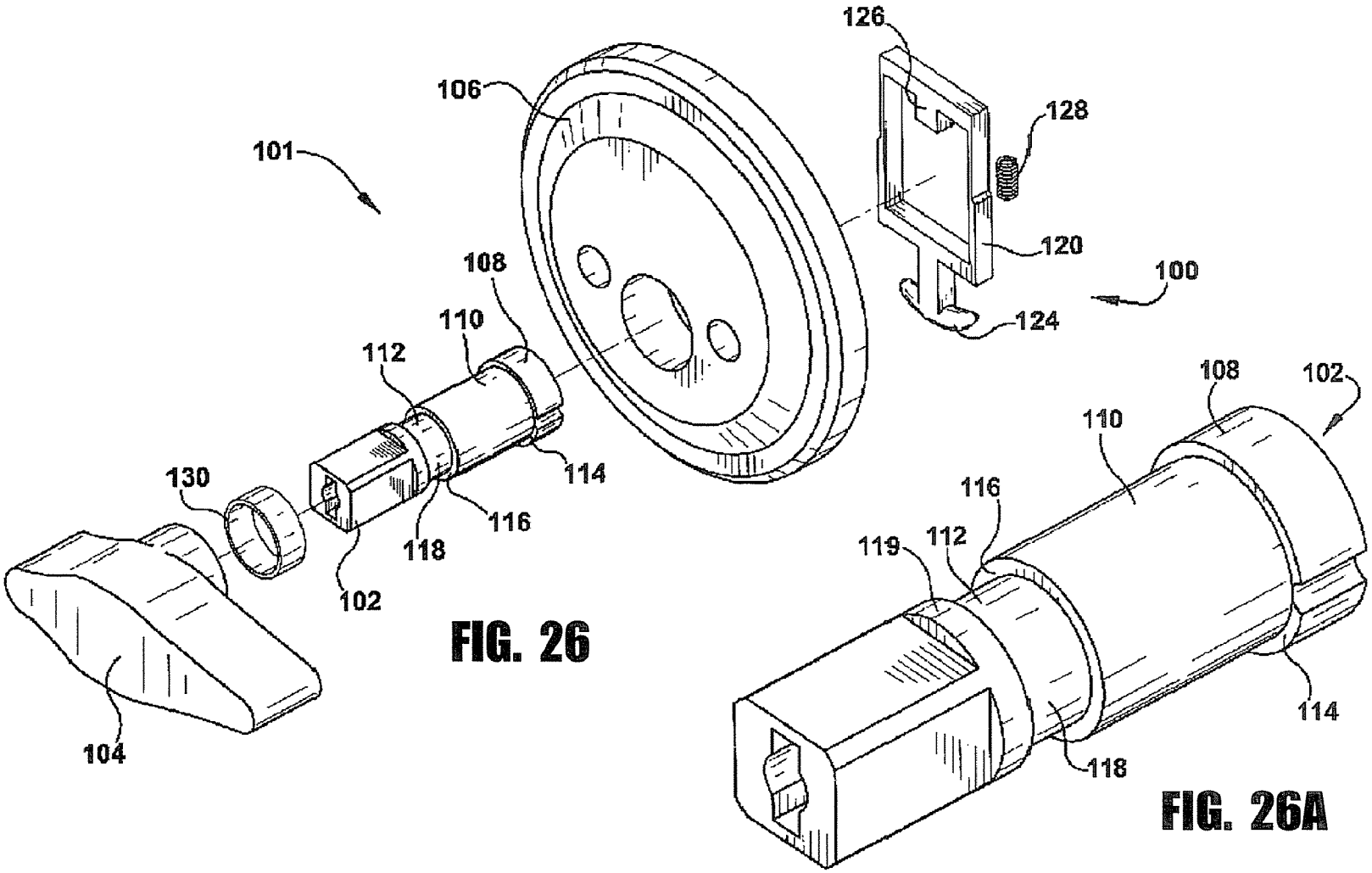
FIG. 26 is an exploded view of a deadbolt lockout mechanism incorporating a release mechanism.
FIG. 26A is a detailed view of the shaft shown in FIG. 26.
Figure 27:
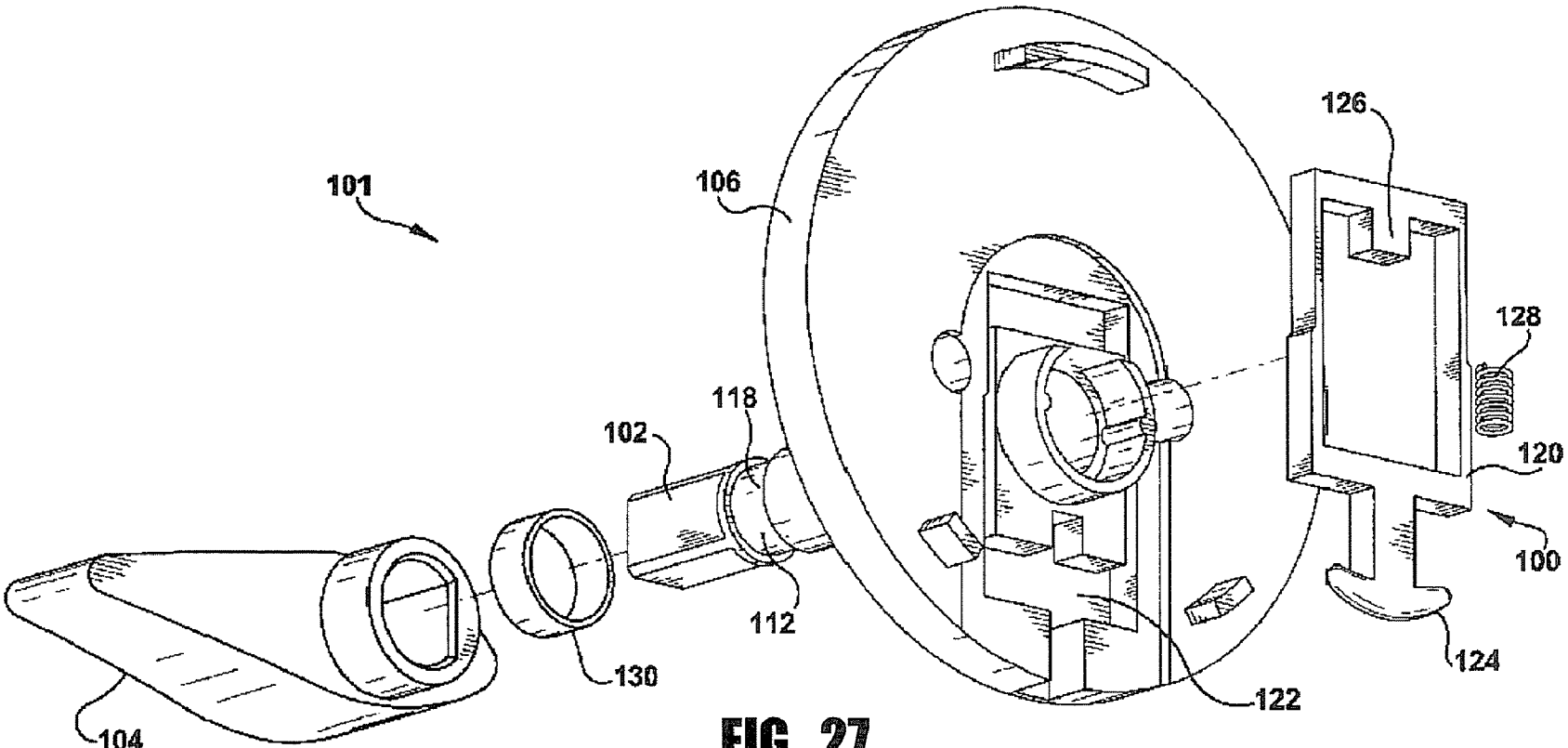
FIG. 27 is an exploded view of a deadbolt lockout mechanism incorporating a release mechanism.
Figure 28:
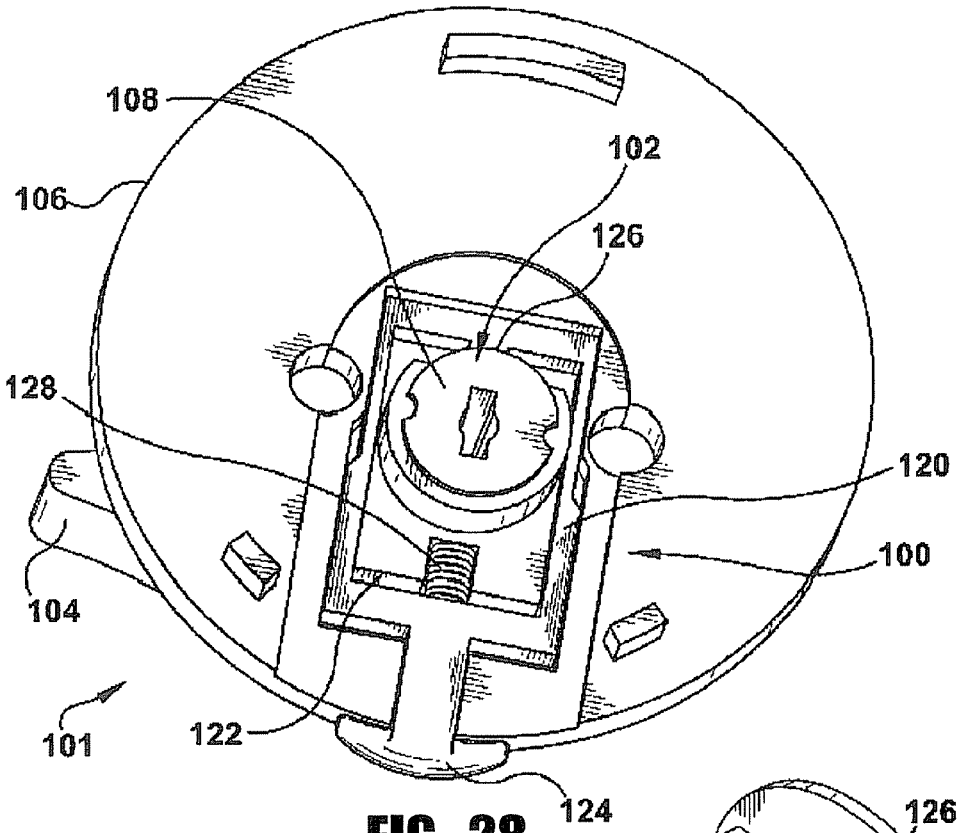
FIG. 28 is an perspective view of a deadbolt lockout mechanism incorporating a release mechanism.

FIGS. 26-28 illustrate one embodiment of a release mechanism 100. FIGS. 26 and 27 are exploded views illustrating the various components of a deadbolt mechanism 101 incorporating a release mechanism 100. Similar to the description above for a deadbolt mechanism 3, a deadbolt mechanism 101 that incorporates a release mechanism 100 includes a shaft 102 that is mechanically coupled to the deadbolt (not shown) such that rotation of the shaft 102 operates the deadbolt. The shaft 102 can be rotated by either a key cylinder or a handle 104. Also as described above, the handle 104 can be pulled outward away from a mounting plate 106 to place the deadbolt in a lockout position and prevent rotation of the shaft 102.

The shaft 102 includes a head portion 108, an intermediate portion 110, and a stop groove portion 112. In this embodiment, all three portions 108, 110, 112 of the shaft 102 are circular in cross-section; however, the shaft 102 is not limited to any particular cross-sectional shape. As best seen in FIGS. 26 and 26A, the head portion 108 is located on one end of the shaft 102. The intermediate portion 110 is located next to the head portion 108 and has a smaller diameter than the head portion 108. The stop groove portion 112 is located next to the intermediate portion 110 and positioned so that the intermediate portion 110 is between the stop groove portion 112 and the head portion 108. The diameter of the stop groove portion 112 is smaller than the diameter of the intermediate portion 110. The difference in diameter between the head portion 108 and the intermediate portion 110 forms a lockout lip 114 at the transition point between head portion 108 and the intermediate portion 110. The difference in diameter of the intermediate portion 110 and the stop groove portion 112 forms an operational lip 116 at the transition point between the intermediate portion 110 and the stop groove portion 112. The stop groove portion 112 includes a groove or cavity 118. As best seen in FIGS. 26 and 26A, the groove 118 is generally a cutout portion that extends circumferentially around the shaft 102 and is bounded by the operational lip 116 on one side and another larger diameter 119 on the other side.

In the embodiment shown in FIGS. 26-28, a pin 120 is used as part of a release mechanism 100. As best shown in FIG. 28, the pin 120 is placed in a channel or opening 122 surrounding the head portion 108 of the shaft 102. The pin 120 includes a button 124 and a stop 126. A spring 128 is used to bias the pin 120 downward, such that the button 124 moves away from the shaft 102. The button 124 extends through the mounting plate 106 such that the button 124 can be manually manipulated to move or operate the pin 120. In this specific embodiment, the button 124 is used to move the pin 120 upward against the spring force. As described below, such movement will disengage the stop 126 from the shaft 102, thereby allowing the handle 104 to be pulled outward away from the mounting plate 106 to place the shaft in the lockout position and prevent rotation of the shaft 102.

The stop 126 engages and disengages the shaft 102 along the groove 118. When the stop 126 is engaged to the groove 118 the lockout function is inactive and the shaft 102 is free to rotate allowing the deadbolt to be locked and unlocked. When unopposed, the bias of spring 128 forces the stop 126 into engagement with the groove 118. When the button 124 is sufficiently pushed upward against the spring force, the stop 126 disengages the groove 118. As the button 124 is pushed upward, the stop 126 can be displaced enough to cause the bottom of the stop 126 to clear the operational lip 116. When the stop 126 is in this position, the shaft 102 can be pulled outward away from the mounting plate 106, which activates the lockout function. As the shaft 102 is pulled outward from the mounting plate 106, the stop 126 can ride along the intermediate potion 110 of the shaft 102 until the stop comes into contact with the lockout lip 114, which can restrains the shaft 102 from being pulled any farther away from the mounting plate 106. A visual signal, such as a colored band 130 can be placed on a portion of the shaft 102, to let users know when the deadbolt is inoperable. To deactivate the lockout function, a user can push the handle 104 back towards the mounting plate 106. The stop 126 can ride along the intermediate portion 110 until it passes the operational lip 116 and reengages the groove 118. In this position the deadbolt becomes operable and the key cylinder or handle 104 is capable of operating the deadbolt.

Figure 29:
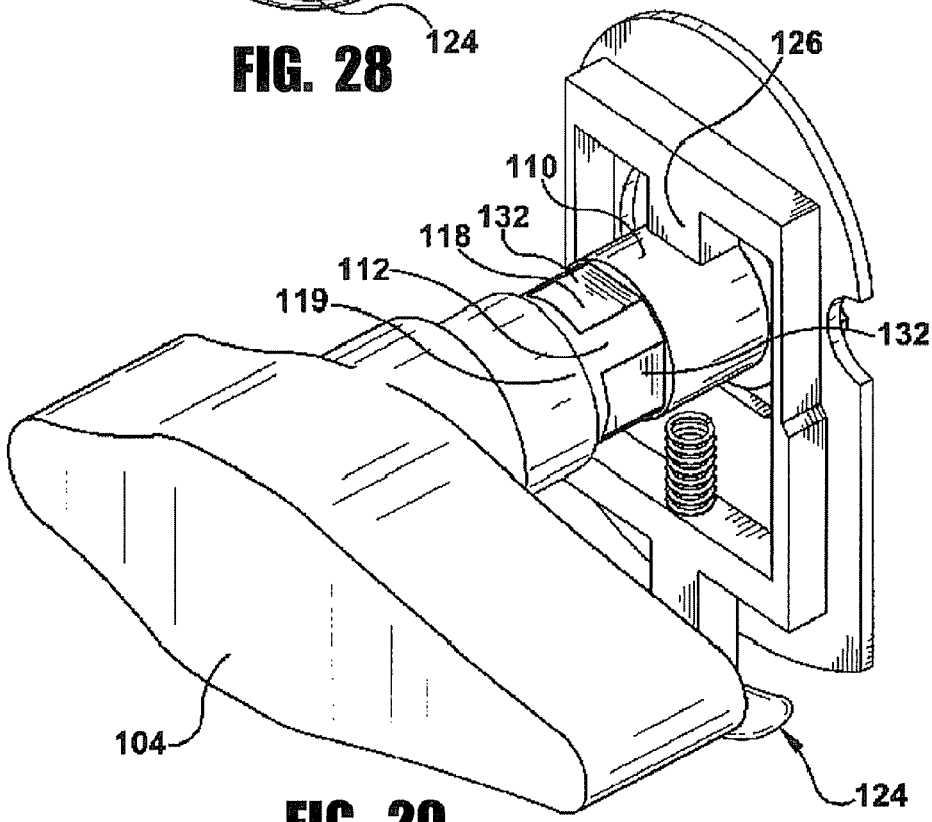
FIG. 29 is an perspective view of a release mechanism for a deadbolt lock with flats on the shaft.
Figure 31:
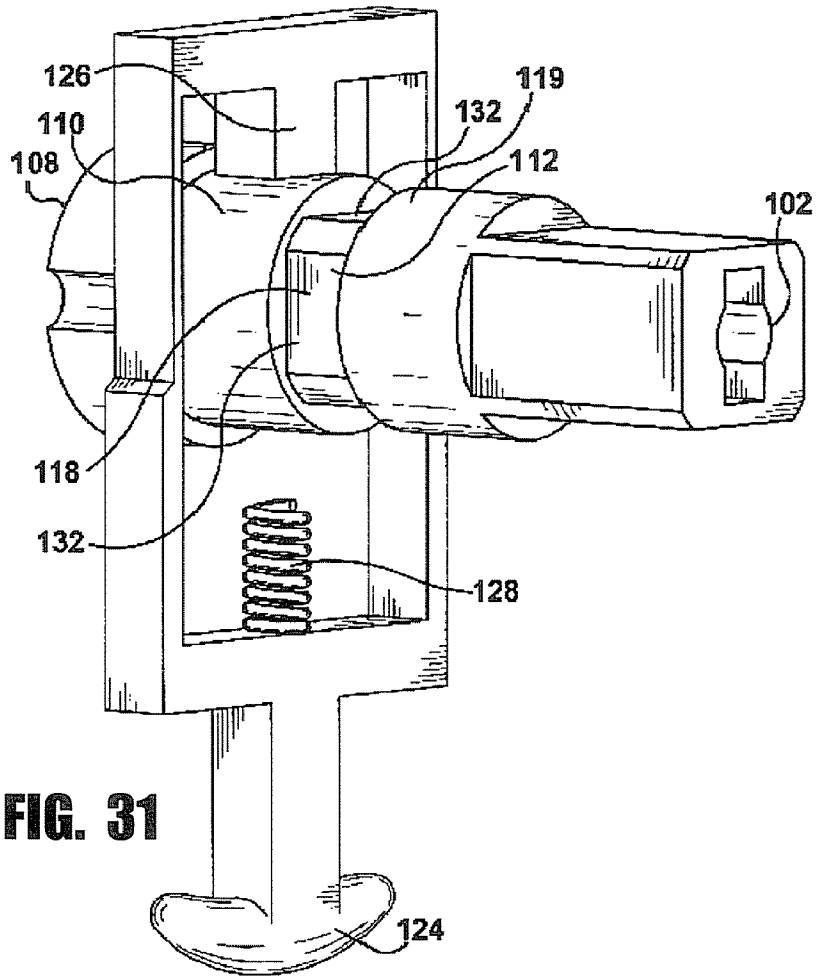
FIG. 31 is an perspective view of a release mechanism for a deadbolt lock with flats on the shaft.
Figure 30:
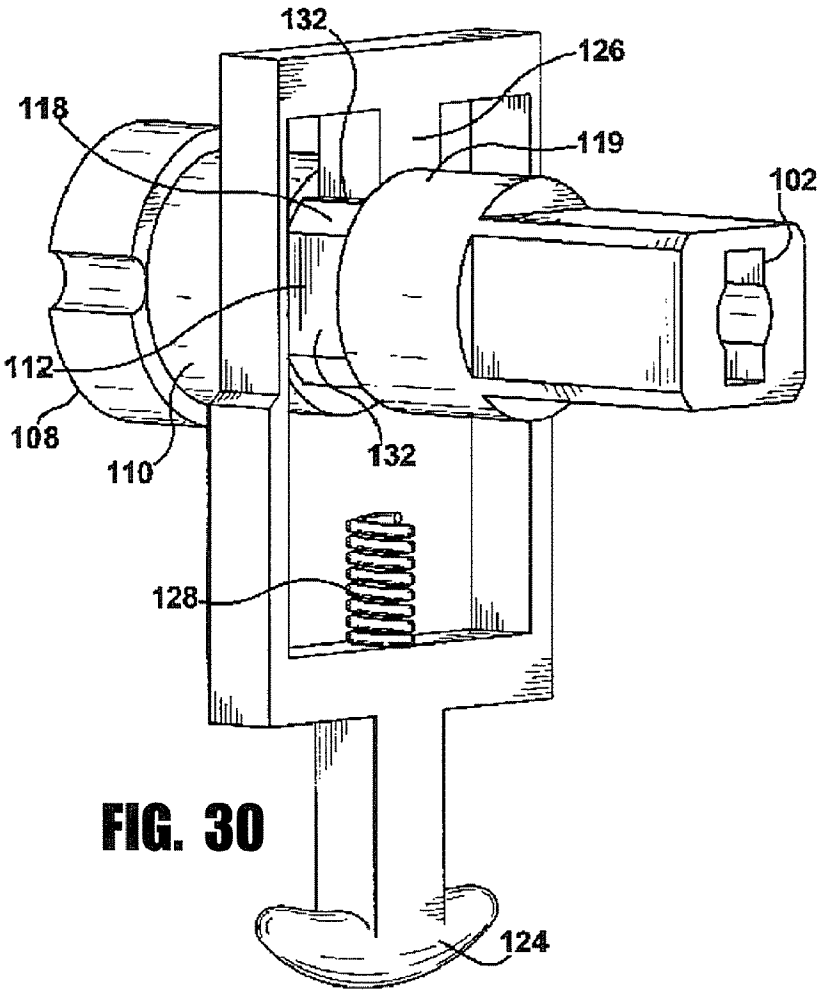
FIG. 30 is an perspective view of a release mechanism for a deadbolt lock with flats on the shaft.

In another embodiment, as seen in FIGS. 29-31, the groove 118 is comprised of four flats 132 positioned ninety degrees apart from each other. When the lockout function is inactive and the stop 126 is engaged with the groove 118, the handle 104, as it is turned, can be positioned in ninety degree increments. The flats 132 interact with the stop 126 to create these ninety degree increments. Each increment positions the deadbolt either in fully extended or a fully retracted position.

In another embodiment, the shaft 102 includes a second groove (not shown) such that the stop 126 coincides with the second groove when the lockout function is activated. In this embodiment, the release mechanism 100 must be actuated to move the shaft 102 from the lockout position to a position where the deadbolt is operable.

The release mechanism 100 can be achieved with a number of different embodiments. FIGS. 32-42 illustrate only some of the many additional embodiments.

Figure 32:
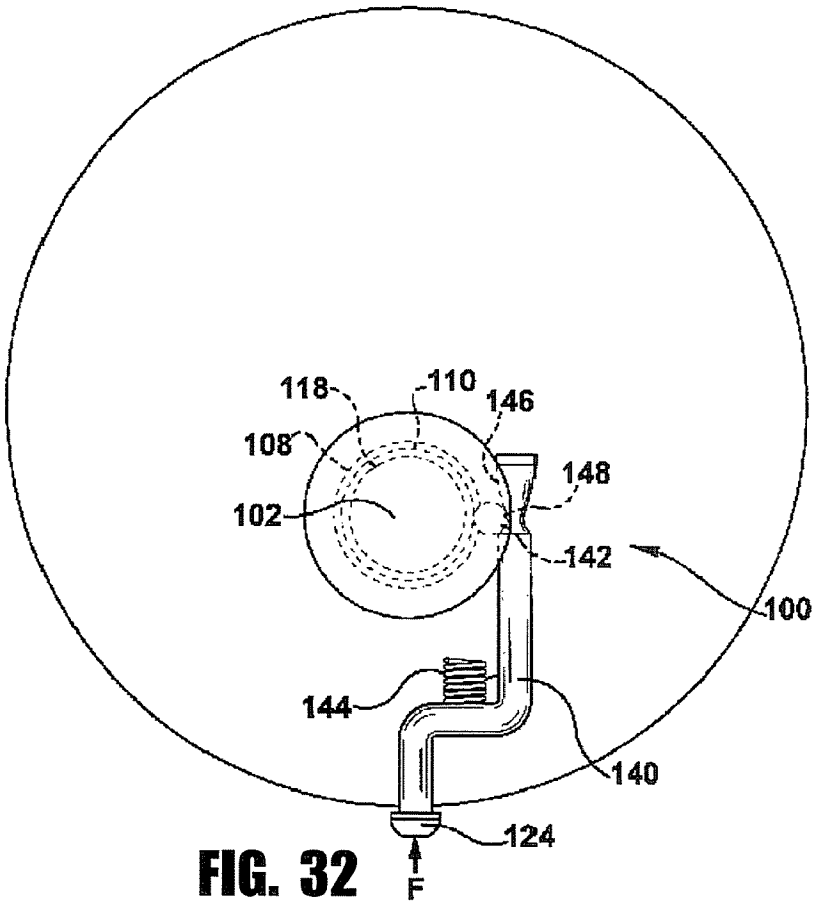

FIG. 32 shows a release mechanism 100 comprising a bent pin 140, a button 124 attached to the bent pin 140, a ball 142 in contact with the bent pin 140, and a spring 144 in contact with the bent pin 140. In this embodiment, when a force F is applied to the button 124 the bent pin 140 moves upward and disengages the release mechanism 100 from the groove 118 and allows the shaft 102 to move axially into a lockout position. The bent pin 140 is biased downward by the spring 144. When the spring 144 biases the bent pin 140 downward to its lowest position (not shown in FIG. 32), the ball 142 is wedged into the groove 118 by an inclined section 146 on the bent pin 140. When the bent pin 140 travels upward to its highest position, due to a force F placed on the button 124, the ball will fall down the inclined section 146 due to gravity and settle in a facet 148 on the bent pin 140. This moves the ball away and out of the groove 118 and past the outer diameter of the intermediate portion 110 (shown by dashed line), thereby releasing the ball 142 from the groove 118 and allowing the shaft 102 to move axially into a lockout position.

Figure 33:
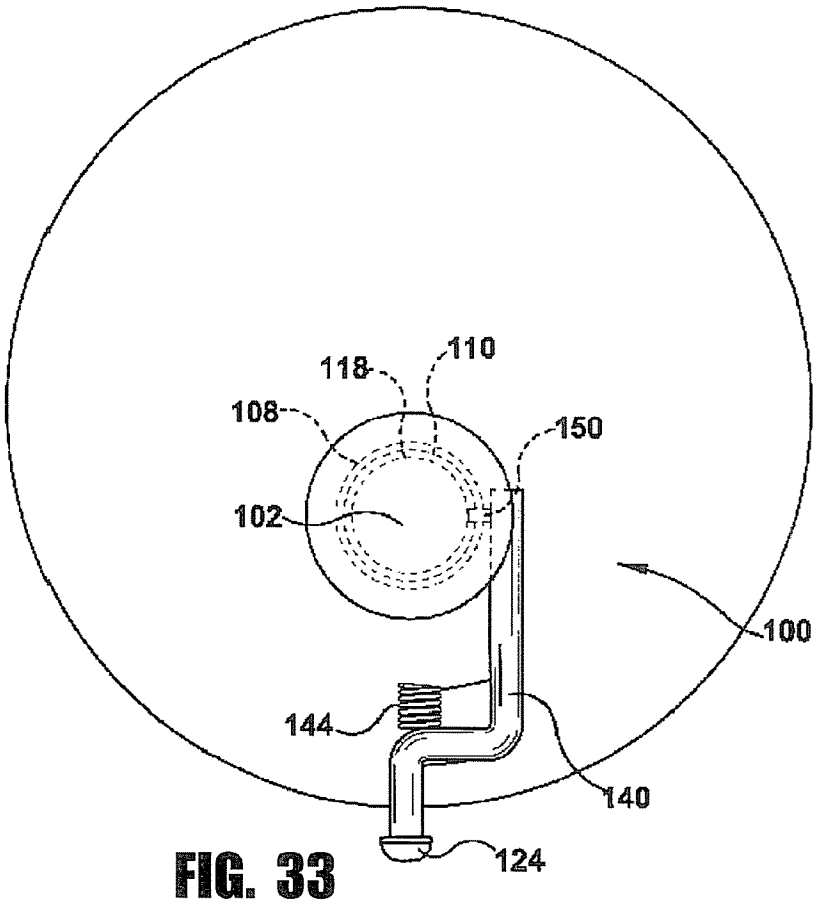
FIGS. 32-42 are schematic views of various embodiments of release mechanisms for a deadbolt lock.

In FIG. 33, the ball of FIG. 32 is replaced with a small protrusion or pin 150, which is secured to the bent pin 140. The protrusion 150 acts as a stop when engaged with the groove 118. As in FIG. 32, the bent pin 140 is biased downward by a spring 144. As a force is applied to the button 124 and the button 124 moves upward, the protrusion 150 will move upward, past the outer diameter of the intermediate portion 110 and out of the groove 118 in the shaft 102. This will release the shaft 102 to be moved into a lockout position.

Figure 35:
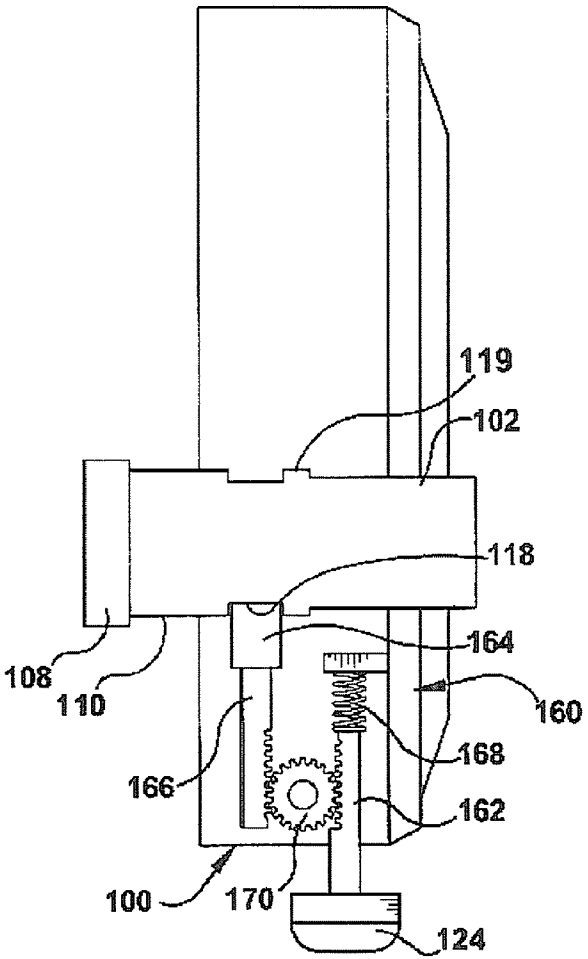
Figure 34:
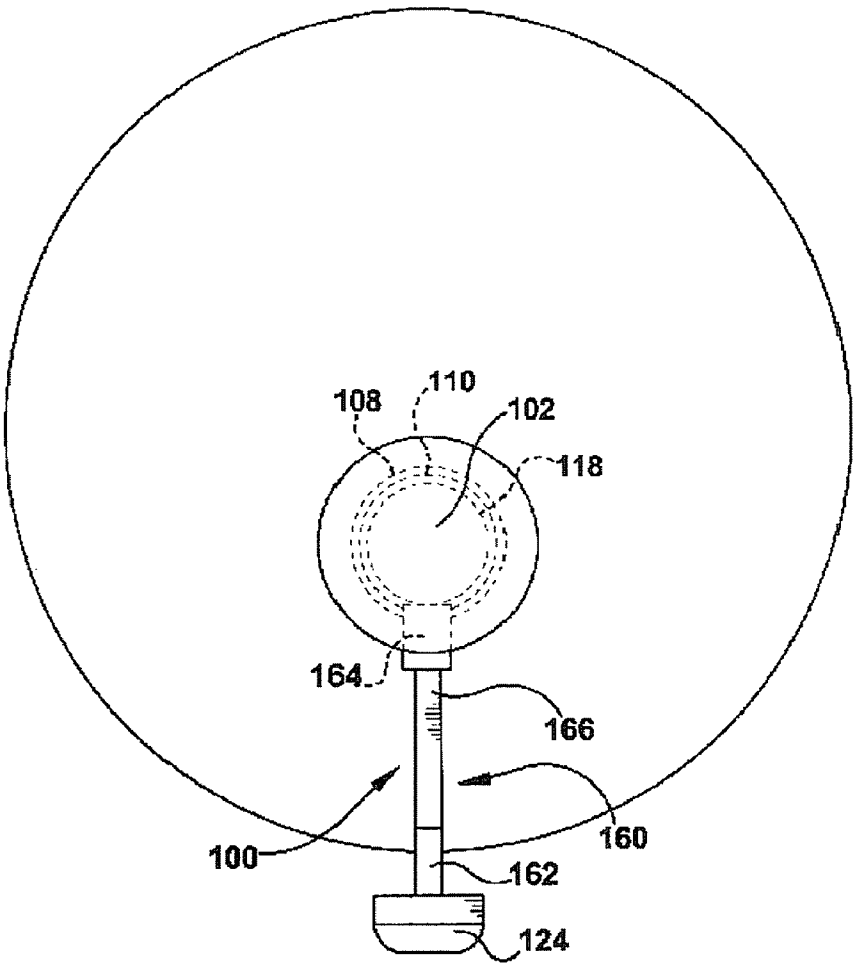

In FIGS. 34 and 35, a rack and pinion mechanism 160 is used to alternatively restrict and allow axial movement of the shaft 102. This embodiment includes a button 124 attached to a button rack 162, a stop 164 attached to a stop rack 166, and a pinion 170 in contact with both racks 162, 166. The button rack 162 is biased or tensioned downward by a spring 168. When the button 124 is pushed upward, the button rack 162 moves upward thereby driving a pinion 170. The rotation of the pinion 170 moves the stop rack 166 downward, which moves the stop 164 out of the groove 118 in the shaft 102. When the stop 164 is moved past the outer diameter of the intermediate portion 110, the shaft 102 is released from the stop 164. Although FIG. 35 shows the spring 168 biasing the button rack 162, it should be understood that a spring could also be positioned to bias the stop rack 164 upward, or a number of other spring or biasing configurations can be used to hold the stop 164 in the groove 118 when the release mechanism 100 is not actuated.

Figure 36:
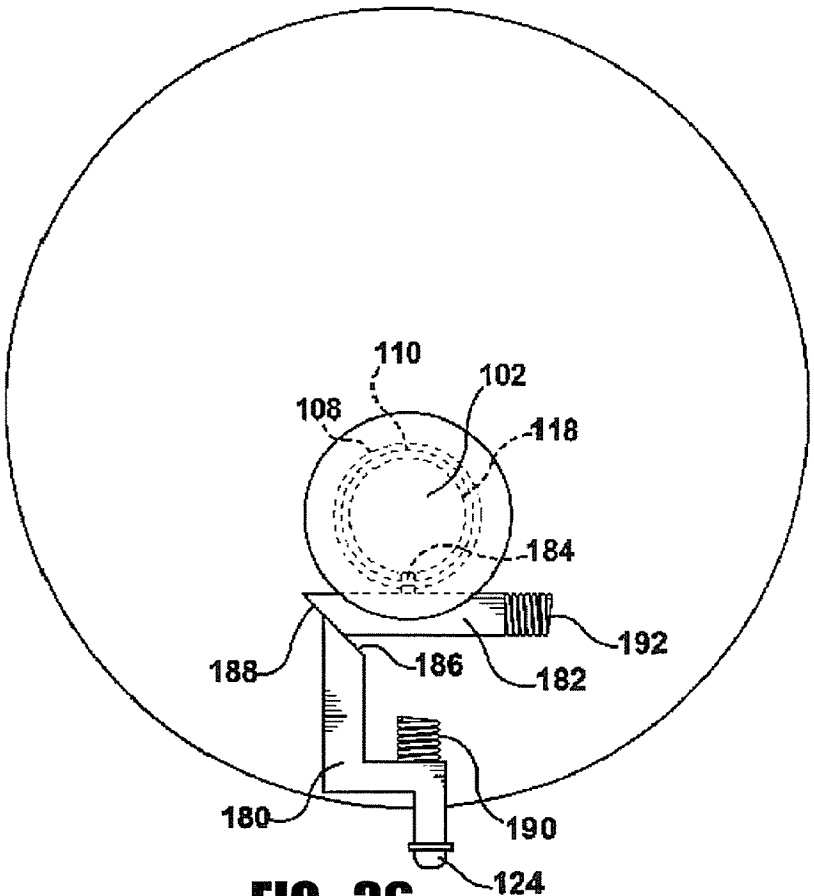

The mechanism of FIG. 36 includes a button 124, a bent pin 180, a straight pin 182, and a protrusion 184. The protrusion 184 is secured to the straight pin 182 and acts as a stop. The button 124 is attached to the bent pin 180. Both the bent and straight pins 180, 182 include inclined surfaces 186, 188 and are biased by springs 190, 192. The biasing of the springs 190, 192 results in a force that moves the bent pin 180 downward. When the button 124 is pressed upward, the bent pin 180 moves upward and transfers motion to the straight pin 182 through the inclined plane 186 of the bent pin 180 sliding along the inclined plane 188 of the straight pin 182. As the protrusion 184 travels along with the straight pin 182 it will move out of the groove 118 in the shaft 102. When the protrusion 184 moves past the outer diameter of the intermediate portion 110 of the shaft 102, the shaft 102 is free to move and can be placed in a lockout position.

Figure 37:
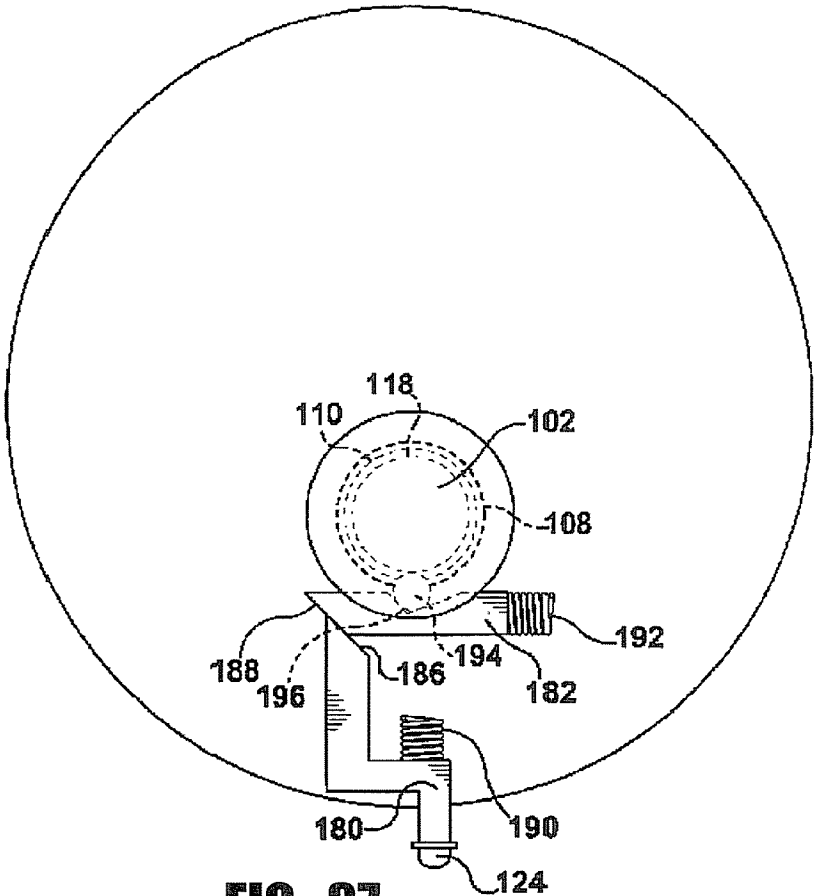

The mechanism shown in FIG. 37 operates in a similar manner as the mechanism of FIG. 36. However, a ball 194 and inclined plane facet or recession 196 replace the protrusion 184. When the bent pin 180 is moved upward, the straight pin 182 moves the ball out of the groove 118, allowing for the shaft 102 to be moved into a lockout position.

Figure 38:
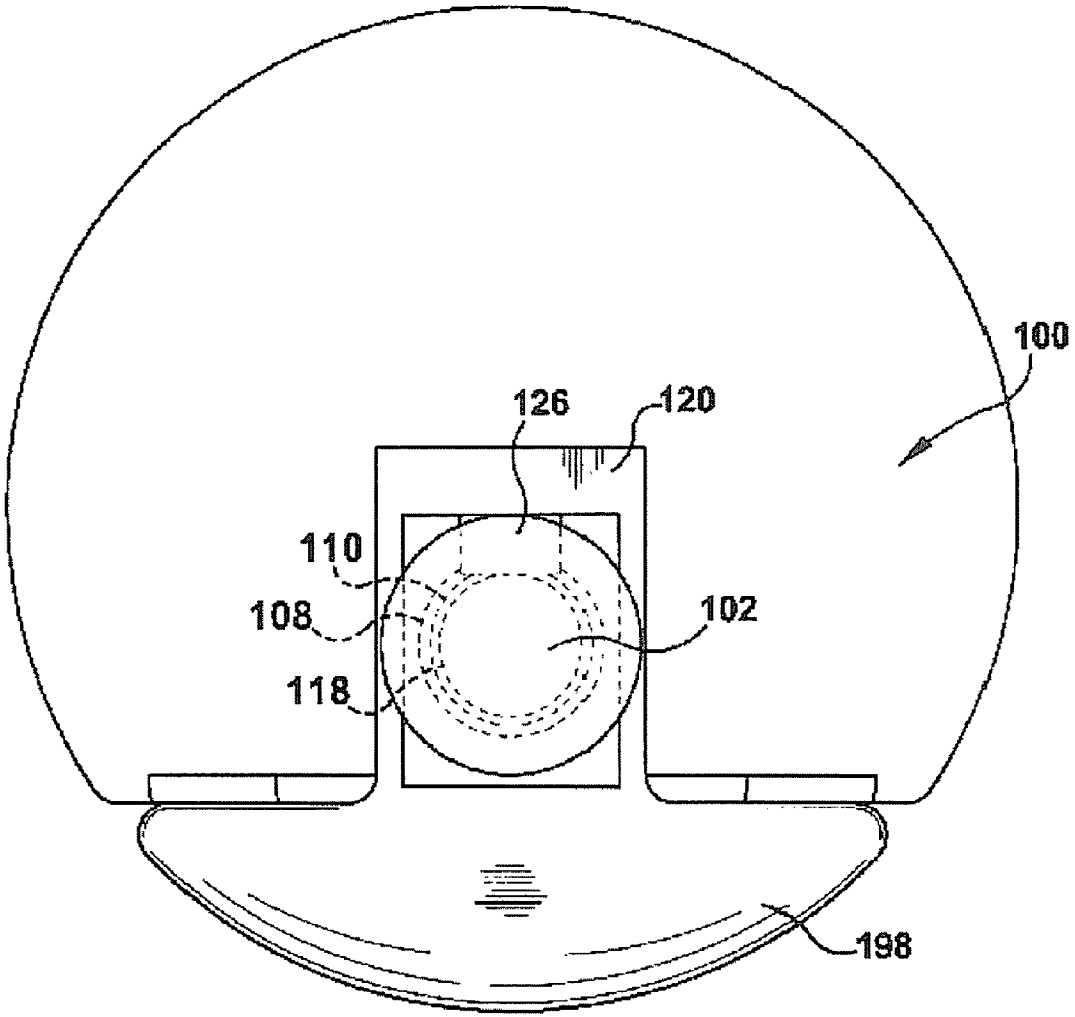

The mechanism shown in FIG. 38 operates in a similar manner as the mechanism described in FIGS. 26-28. In this embodiment, the size of the button 198 has been increased to allow for easier operation or the release mechanism 100. The size of the button 198, which is increased to the size of a handle that fits inside a hand, can provide a blunt engagement surface that may allow the user to more easily use the palm of the hand to place force on the button 198. FIG. 38 illustrates the flexibility of modifying the button and insert to support the release mechanism 100. A handle can be used in place of a button in any embodiment herein described.

Figure 40:
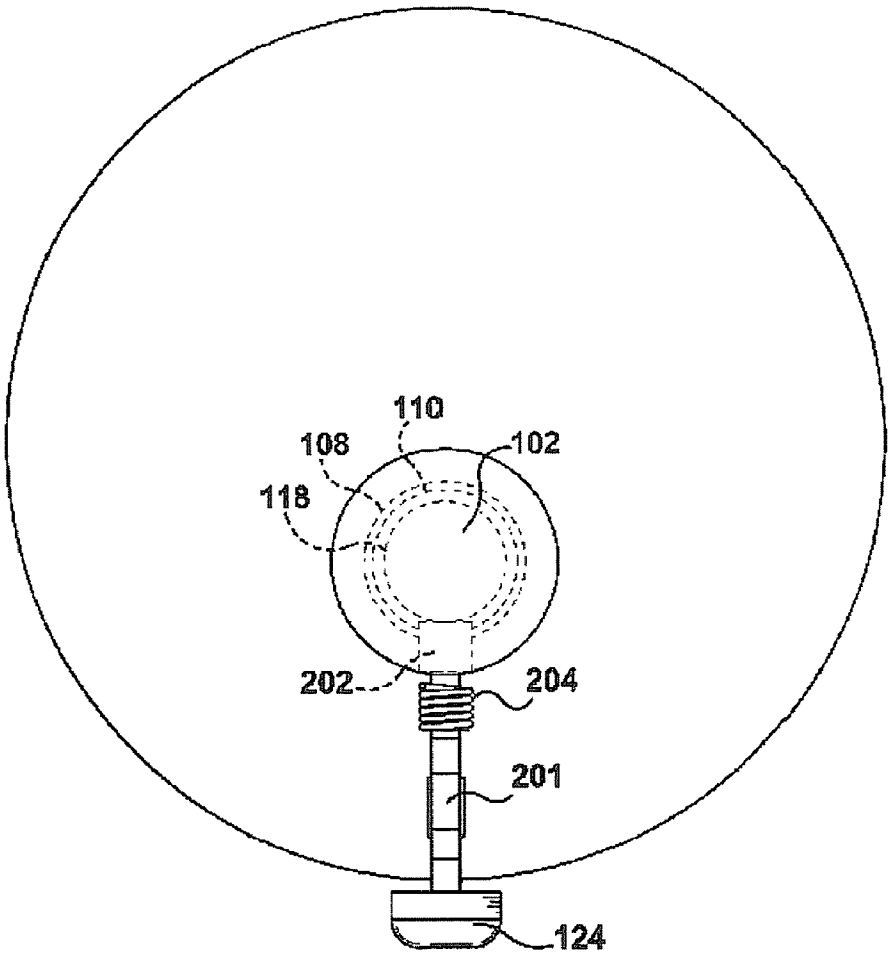
Figure 39:
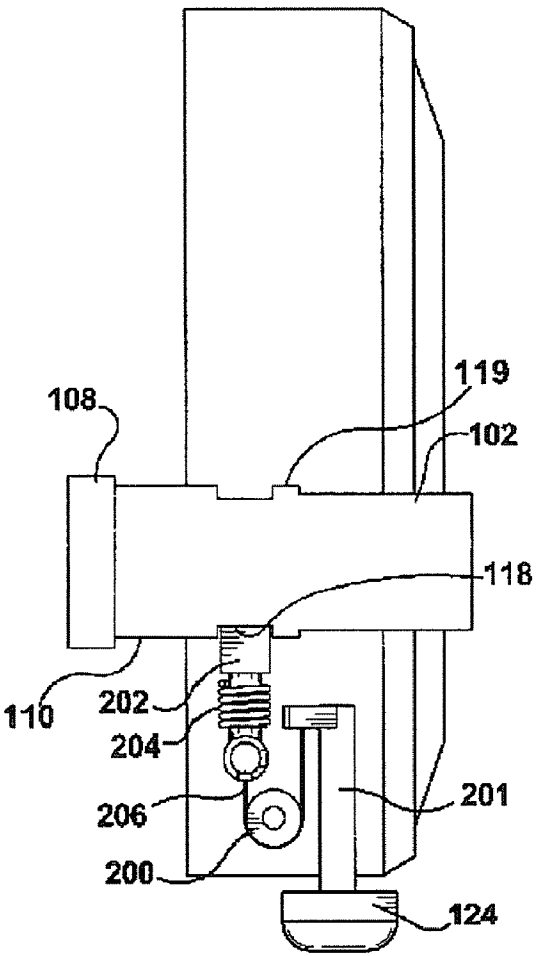

In FIGS. 39 and 40, a pulley 200, a button 124, a button pin 201, a stop 202, a spring 204, and a high strength string or wire 206 (e.g. 20 lb test fishing line) are used to activate and inactive axial movement of the shaft 102. The button 124 is attached to the button pin 201, which is attached to the wire 206. The wire rides along the pulley 200 and is attached to the stop 202. The spring 204 biases the stop upward and into the groove 118. As the button 124 is pushed upward, the line 206 transfers the motion around the pulley 200 to pull the stop 202 downward. As the stop 202 travels downward and out of the groove 118 of the shaft 102, the shaft 102 is released and is free to be moved into a lockout position.

Figure 41:
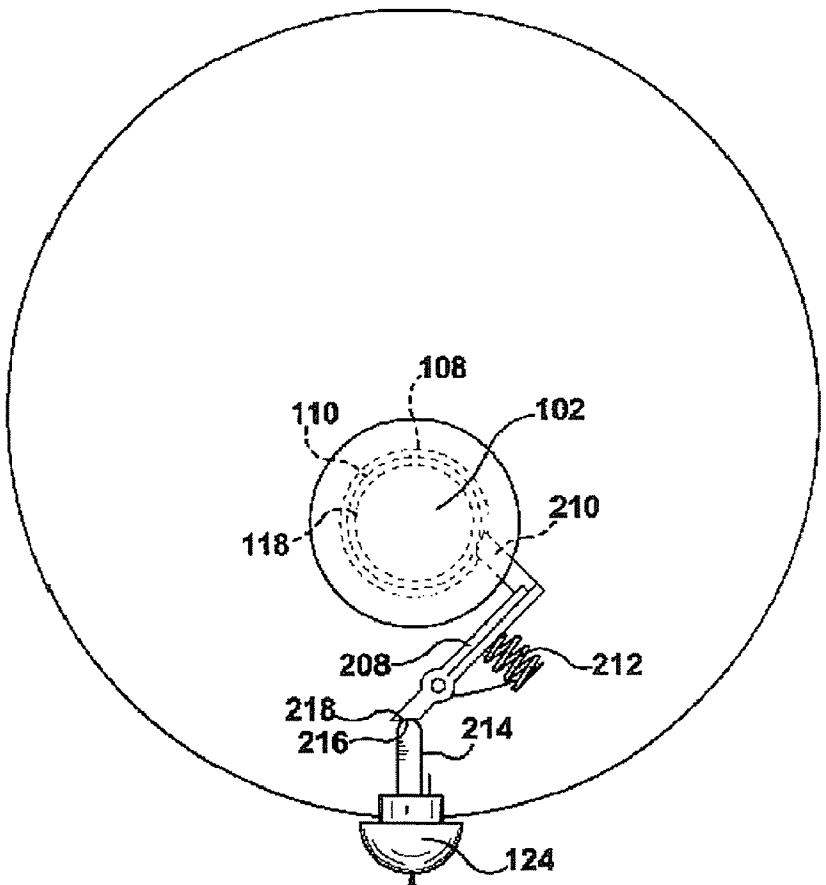

In FIG. 41, a button 124, a lever 208 with a stop 210, and a spring 212 are used to activate axial movement of the shaft 102. The button 124 is attached to a button pin 214, which has a rounded end 216 for contacting the lever 208. The lever end 218 has a radius to receive the rounded end 216 of a button pin 214. A spring biases the lever 208 towards the shaft and when unopposed, moves the stop 210 into the groove 118. When the button 124 is moved upward by a force F, as shown in FIG. 41, the lever 208 will rotate and the stop 210 will move out of the groove 118. When the stop 210 has moved past the outer diameter of the intermediate portion 110 (as seen in FIG. 41), the shaft 102 is free to be moved into a lockout position.

Figure 42:
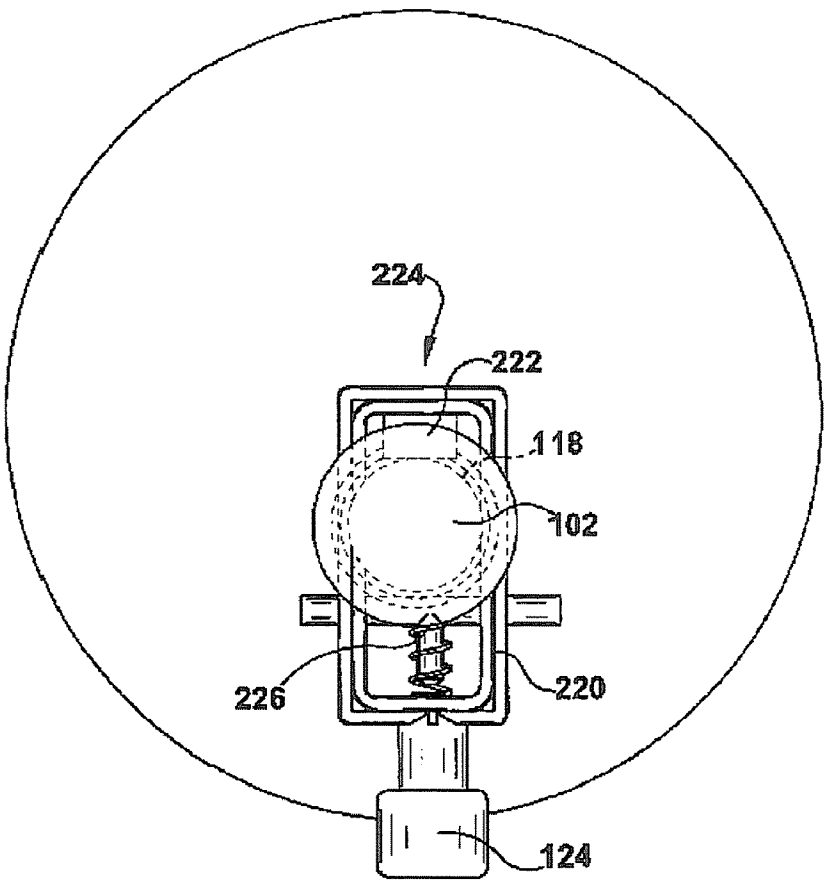

In FIG. 42, a button 124, pin 220, stop 222, and spring detent 226 are integrated as a single piece or sub-assembly 224. When the button 124 is moved upward, that motion is transferred such that the stop 222 is released from engagement with the groove 118 in the shaft 102. Once the stop 222 is disengaged from the groove 118 in the shaft 102, the shaft 102 may be moved axially and into a lockout position.

Figure 43:
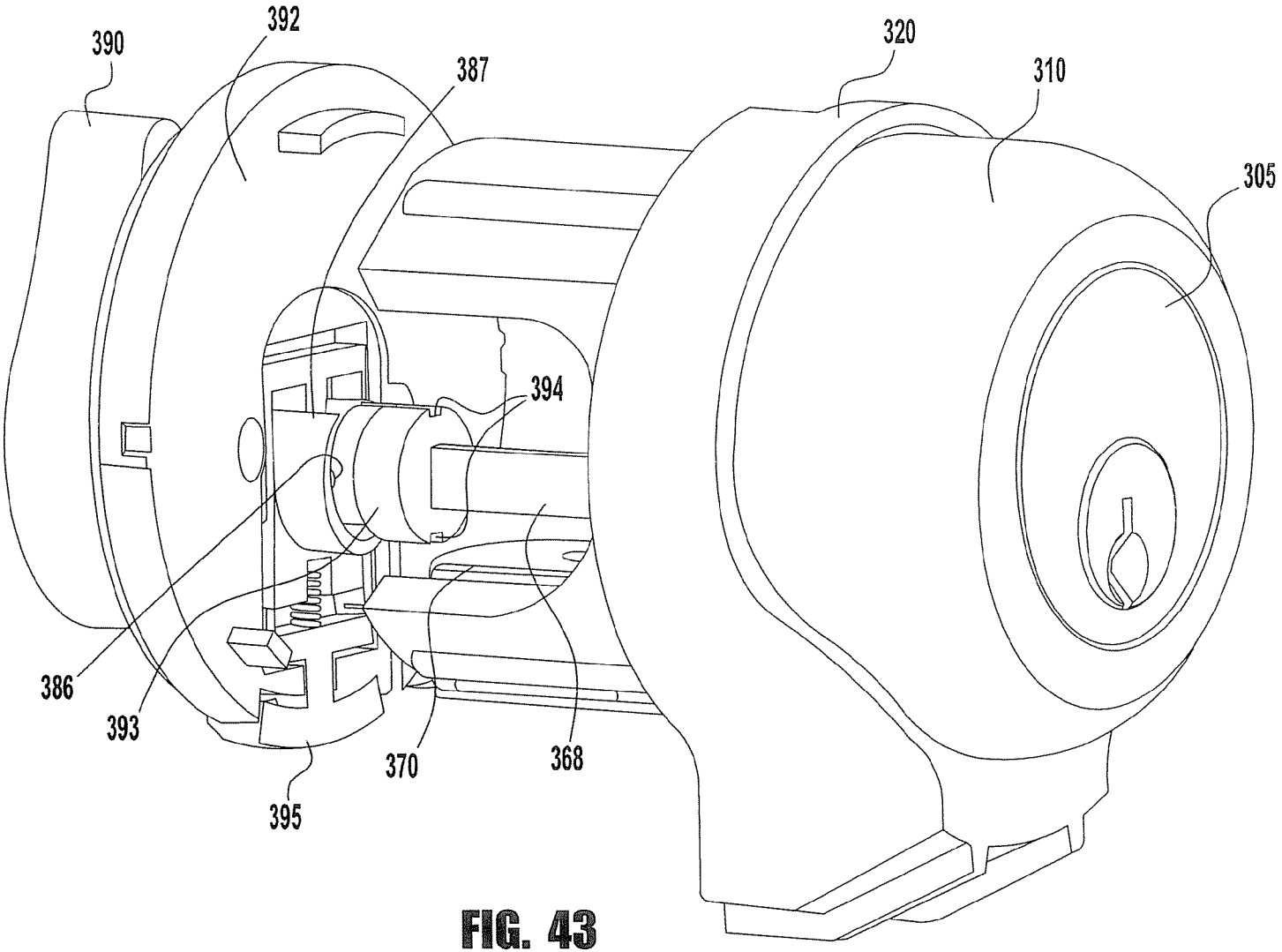
FIG. 43 is a side perspective view of the deadbolt locking arrangement of FIG. 1, with portions removed to illustrate a deadbolt lockout mechanism incorporating a release mechanism.
Figure 44:
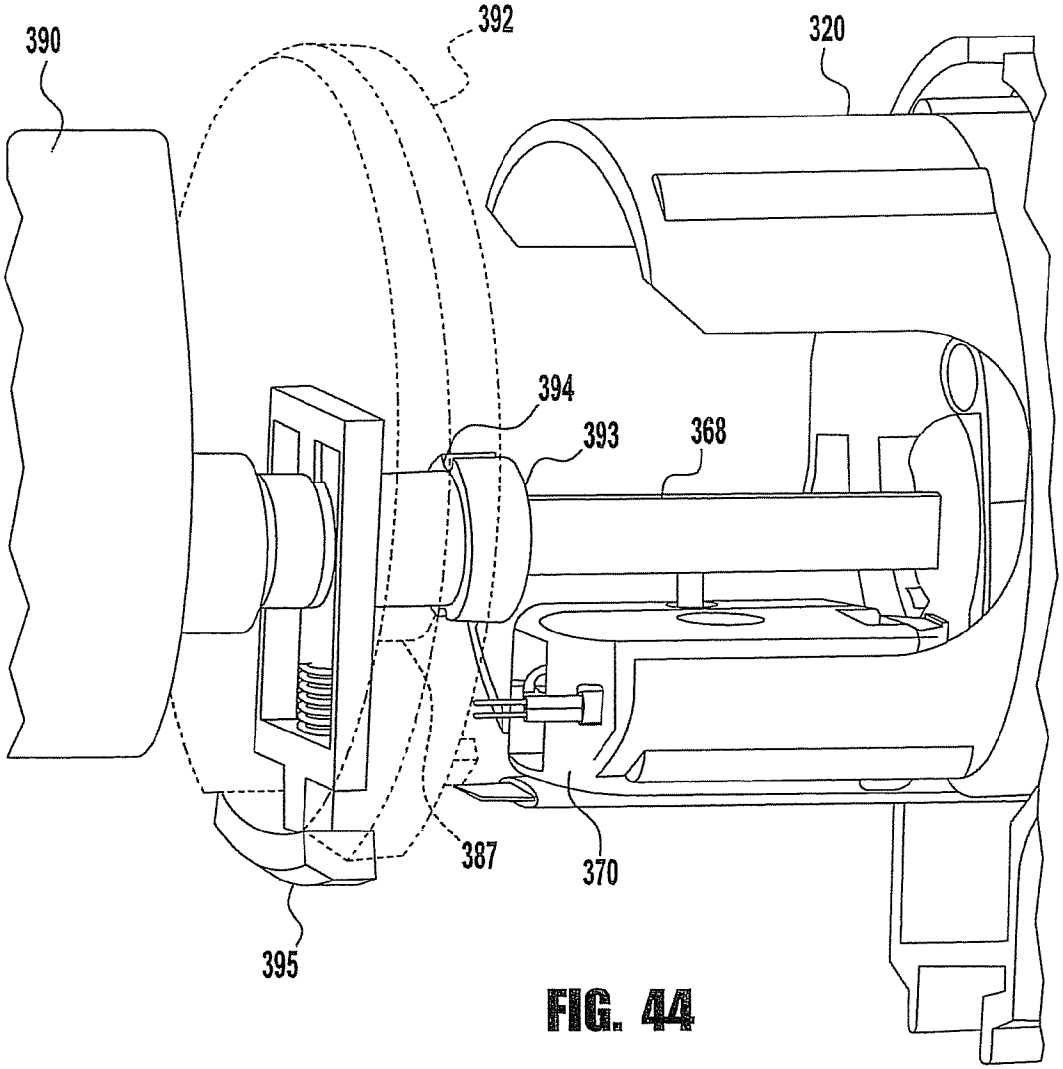
FIG. 44 is another side perspective view of the deadbolt locking arrangement of FIG. 1, with portions removed to illustrate a deadbolt lockout mechanism incorporating a release mechanism.

As indicated above, a deadlock lockout device (with or without a lockout enabling or release mechanism) may be provided to limit use of any deadbolt operating mechanism, including, for example, a lock interface enabled manually operated locking member, such as the biometric enabled actuator embodiment of FIGS. 1-5. FIGS. 43 and 44 illustrate portions of the deadbolt locking arrangement 300 of FIGS. 1-5, to show an exemplary optional lockout mechanism with a button or compressible pin 395 for selectively enabling the lockout mechanism. As shown, the lockout mechanism may include a shaft 393 that engages the actuating blade 368 to rotate the actuating blade when the knob 390 is turned between locked and unlocked positions. The shaft 393 may be axially slideable between an operable position (shown in FIGS. 43 and 44) and an inoperable position in which depressions 394 in the sides of the shaft 393 receive protuberances 386 disposed on a collar 387 extending from the mounting plate 392, thereby preventing rotation of the shaft 393 relative to the collar 387. While many different types of shafts may be utilized to allow for operation of the deadbolt and lockout of such operation, in one embodiment, the shaft 393 is consistent with the shaft 10 of FIGS. 7-11, described in greater detail above.

To reduce the risk of inadvertent lockout, a spring loaded button or pin 395 is configured to engage the shaft 393 to limit axial movement of the shaft until a user presses the pin 395 to disengage a portion of the pin from the shaft 393. The illustrated release mechanism is consistent with the mechanism illustrated in FIGS. 25-31 and described in greater detail above. Many other types of lockout release mechanisms may be employed, including, for example, the various alternative embodiments of FIGS. 32-42, described in greater detail above.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A deadbolt lock for assembly with a door, the deadbolt lock comprising:

a deadbolt movable between locked and unlocked positions;

a user rotatable actuator rotatable about a central axis and accessible from an exterior side of a door when the deadbolt lock is assembled with the door;

an actuation translating component selectively connecting the actuator to the deadbolt;

a latch mechanism having a body portion and a holding portion for engaging the actuation translating component; and a lock interface accessible from the exterior side of the door when the deadbolt lock is assembled with the door, the lock interface being configured to change the holding portion of the latch mechanism from a first condition in which the holding portion is retractable with respect to the body portion to a second condition in which the holding portion is secured in an extended condition with respect to the body portion, in response to proper user manipulation of the lock interface;

wherein when the holding portion is in the first condition, rotation of the actuator moves the actuation translating component against the retractable holding portion and out of engagement with the actuator to prevent operation of the deadbolt; and further wherein when the holding portion is in the second condition, the holding portion secures the actuation translating component in operative engagement with the actuator, such that rotation of the actuator moves the deadbolt between the locked position and the unlocked position.

2. The deadbolt lock of claim 1, further comprising a lock cylinder operable to move the deadbolt between locked and unlocked conditions, wherein the actuator comprises a cover member configured to cover at least a portion of the lock cylinder.

3. The deadbolt lock of claim 1, wherein the actuation translating component comprises a clutch ring, wherein the clutch ring securely engages an end portion of the actuator for mutual rotation of the actuator and clutch ring when the holding portion of the latch mechanism is in the second condition.

4. The deadbolt lock of claim 3, wherein the actuator comprises at least one notch and the clutch ring comprises at least one projection, wherein the at least one projection securely engages the at least one notch when the holding portion of the latch mechanism is in the second condition.

5. The deadbolt lock of claim 3, wherein the latch mechanism comprises an electronic latch connected with the lock interface, wherein proper user manipulation of the lock interface energizes the electronic latch to hold the clutch ring in secure engagement with the actuator.

6. The deadbolt lock of claim 3, further comprising a drive arm assembled with the clutch ring, the drive arm providing an operative connection between the clutch ring and the deadbolt.

7. The deadbolt lock of claim 6, wherein the clutch ring is axially slideable with respect to each of the actuator and the drive arm.

8. The deadbolt lock of claim 1, wherein the lock interface is configured to receive a data signal for comparison with one or more stored authorized data signals.

9. The deadbolt lock of claim 8, wherein the one or more stored authorized data signals are associated with an inherent trait of an authorized user.

10. The deadbolt lock of claim 9, wherein the inherent trait comprises a fingerprint pattern.

11. The deadbolt lock of claim 1, further comprising a lockout mechanism accessible from an interior side of a door when the deadbolt lock is assembled with the door, the lockout mechanism being configured such that when the actuator is in an operable condition and the lockout mechanism is moved to a lockout position, the lockout mechanism prevents rotation of the actuator to move the deadbolt between locked and unlocked positions.

12. The deadbolt lock of claim 11, wherein the lockout mechanism comprises a shaft operatively connected with the actuator when the actuator is in an operable condition, the shaft including a head portion having at least one depression, and a shaft housing including an opening for receiving said shaft and a collar surrounding at least a portion of said opening, wherein said head portion of said shaft is selectively movable into and out of nesting engagement with the collar such that when the head portion is nested within the collar, the at least one depression engages one or more portions of the collar, thereby preventing rotation of the shaft.

13. The deadbolt lock of claim 11, wherein the lockout mechanism further comprises an indication mechanism for providing a visual indication when the lockout mechanism is in the lockout position.

14. The deadbolt lock of claim 11, wherein the lockout mechanism further comprises a lockout release mechanism, wherein movement of the lockout release mechanism from an engaging position to a release position permits movement of the lockout mechanism to the lockout position.

15. The deadbolt lock of claim 14, wherein when the lockout mechanism is in the lockout position and the lockout release mechanism is in the engaging position, the lockout mechanism is freely moveable out of the lockout position.

16. The deadbolt lock of claim 4, wherein the at least one notch and the at least one projection include complementary tapered edges, such that when the holding portion of the latch mechanism is in the second condition, rotation of the actuator axially slides the clutch ring to disengage the at least one projection from the corresponding notch.

17. A deadbolt lock comprising:

a deadbolt movable between locked and unlocked positions;

a manually operable locking member operatively connected with the deadbolt for movement of the deadbolt between locked and unlocked conditions when the locking member is changed from an inoperable condition to an operable condition;

an actuation translating component selectively connecting the deadbolt with the locking member and movable with respect to the locking member;

a latch mechanism having a body portion and a retractable holding portion extending from the body portion to bias the actuation translating component into engagement with the locking member, wherein when the locking member is in the inoperable condition, movement of the locking member moves the actuation translating component against the retractable holding portion and out of engagement with the locking member to prevent operation of the deadbolt; and a lock interface accessible from an exterior side of a door when the deadbolt lock is assembled with the door, the lock interface being configured to change the manually operable locking member from the inoperable condition to the operable condition by securing the holding portion of the latch mechanism in an extended position to secure the actuation translating component in operative engagement with the locking member when the lock interface receives an authorized data signal, such that rotation of the locking member moves the deadbolt between the locked position and the unlocked position.

18. The deadbolt lock of claim 17, wherein the lock interface comprises a fingerprint scanner and the authorized data signal is associated with a fingerprint of an authorized user.

19. The deadbolt lock of claim 17, wherein the latch mechanism comprises an electronic latch that is energized to secure the holding portion in the extended position to operatively connect the locking member with the deadbolt when the lock interface receives an authorized data signal.

20. A lock comprising:

a locking mechanism movable between locked and unlocked positions;

a user rotatable actuator rotatable about a central axis;

an actuation translating component selectively connecting the actuator to the locking mechanism;

a latch mechanism having a body portion and a holding portion extending axially from the body portion to engage the actuation translating component; and a lock interface configured to change the holding portion of the latch mechanism from a first condition in which the holding portion is retractable with respect to the body portion to a second condition in which the holding portion is secured in an extended condition with respect to the body portion, in response to proper user manipulation of the lock interface;

wherein when the holding portion is in the first condition, rotation of the actuator axially slides the actuation translating component against the retractable holding portion and out of engagement with the actuator to prevent operation of the locking mechanism; and further wherein when the holding portion is in the second condition, the holding portion secures the actuation translating component in operative engagement with the actuator, such that rotation of the actuator moves the locking mechanism between the locked position and the unlocked position.

21. The lock of claim 20, wherein the latch mechanism comprises an electronic latch connected with the lock interface, wherein proper user manipulation of the lock interface energizes the electronic latch to secure the holding portion in the extended position.

22. The lock of claim 20, wherein the actuation translating component comprises a clutch ring, wherein the clutch ring securely engages an end portion of the actuator for mutual rotation of the actuator and clutch ring when the holding portion of the latch mechanism is in the second condition.

23. The lock of claim 22, wherein the actuator comprises at least one notch and the clutch ring comprises at least one projection, wherein the at least one projection securely engages the at least one notch when the holding portion of the latch mechanism is in the second condition.

24. The lock of claim 22, further comprising a drive arm assembled with the clutch ring, the drive arm providing an operative connection between the clutch ring and the locking mechanism, wherein the clutch ring is axially slideable with respect to each of the actuator and the drive arm.

25. A lock comprising:

a locking mechanism movable between locked and unlocked positions;

a manually operable locking member operatively connected with the locking mechanism for movement of the locking mechanism between locked and unlocked conditions when the locking member is changed from an inoperable condition to an operable condition;

an actuation translating component selectively connecting the locking mechanism with the locking member and movable with respect to the locking member;

a latch mechanism having a body portion and a retractable holding portion extending from the body portion to bias the actuation translating component into engagement with the locking member, wherein when the locking member is in the inoperable condition, movement of the locking member moves the actuation translating component against the retractable holding portion and out of engagement with the locking member to prevent operation of the locking mechanism; and a lock interface configured to change the manually operable locking member from the inoperable condition to the operable condition by securing the holding portion of the latch mechanism in an extended position to secure the actuation translating component in operative engagement with the locking member when the lock interface receives an authorized data signal, such that movement of the locking member moves the locking mechanism between the locked position and the unlocked position.

26. The lock of claim 25, wherein the latch mechanism comprises an electronic latch that is energized to secure the holding portion in the extended position when the lock interface receives an authorized data signal.

27. The lock of claim 25, wherein the actuation translating component comprises a clutch ring, wherein the clutch ring securely engages an end portion of the locking member for mutual movement of the locking member and clutch ring when the locking member is in the operable condition.

28. The lock of claim 27, wherein the locking member comprises at least one notch and the clutch ring comprises at least one projection, wherein the at least one projection securely engages the at least one notch when the locking member is in the operable condition. wherein the at least one notch and the at least one projection include complementary tapered edges, such that when the locking member is in the inoperable condition, movement of the locking member axially slides the clutch ring to disengage the at least one projection from the corresponding notch.

* * * * *